US007771336B2

(12) United States Patent
Shoji et al.

(10) Patent No.: US 7,771,336 B2
(45) Date of Patent: Aug. 10, 2010

(54) FOLDER FOR ROTARY PRESS

(75) Inventors: Yukikazu Shoji, Hiroshima-ken (JP); Mikio Motooka, Hiroshima-ken (JP); Isami Mitamura, Hiroshima-ken (JP); Kunihiro Shichijo, Hiroshima-ken (JP)

(73) Assignee: Mitsubishi Heavy Industries, Ltd, Tokyo (JP)

( * ) Notice: Subject to any disclaimer, the term of this patent is extended or adjusted under 35 U.S.C. 154(b) by 75 days.

(21) Appl. No.: 10/566,989

(22) PCT Filed: Dec. 8, 2004

(86) PCT No.: PCT/JP2004/018294

§ 371 (c)(1),
(2), (4) Date: Mar. 8, 2006

(87) PCT Pub. No.: WO2005/056451

PCT Pub. Date: Jun. 23, 2005

(65) Prior Publication Data

US 2007/0018373 A1 Jan. 25, 2007

(30) Foreign Application Priority Data

Dec. 12, 2003 (JP) ..... 2003-415124

(51) Int. Cl.
*B31B 1/16* (2006.01)

(52) U.S. Cl. ..... 493/362; 493/324; 493/345; 493/358; 493/416; 493/417; 493/424

(58) Field of Classification Search ..... 493/324, 493/345, 352, 356–362, 364–368, 405, 416, 493/417, 422, 424–429, 436, 442–444, 446–447, 493/454, 456

See application file for complete search history.

(56) References Cited

U.S. PATENT DOCUMENTS 4,381,106 A * 4/1983 Loebach ..... 270/47
4,491,310 A * 1/1985 Reffert ..... 270/49
4,564,470 A * 1/1986 Schmitt ..... 270/21.1

(Continued)

FOREIGN PATENT DOCUMENTS

JP 59-143863 8/1984

(Continued)

*Primary Examiner*—Christopher Harmon
(74) *Attorney, Agent, or Firm*—Manabu Kanesaka; Kenneth M. Berner; Benjamin J. Hauptman

(57) ABSTRACT

In a variable cut-off length type rotary printing machine, to perform processes such as a process of folding a cut-off sheet with a high degree of accuracy, a folding machine includes a cut-off unit capable of varying and cutting a cut-off length of a web fed from a printing machine of the rotary printing machine, and a processor (such as a folder, etc.) for processing a sheet 10*a* cut off by the cut-off unit. Between the cut-off unit 50 and the processor, the folding machine further includes a first belt conveyor for conveying the sheet at a speed equal to the web, and a second belt conveyor for receiving the sheet from the first belt conveyor at a speed approximately equal to the sheet conveying speed of the first belt conveyor, then varying the conveying speed to a speed approximately equal to the sheet conveying speed of the processor, and delivering the sheet to processor.

16 Claims, 19 Drawing Sheets

U.S. PATENT DOCUMENTS

| | | | | |
|---|---|---|---|---|
| 4,721,294 | A * | 1/1988 | Petersen | 270/37 |
| 4,798,575 | A * | 1/1989 | Siversson | 493/346 |
| 4,812,195 | A * | 3/1989 | Vijuk | 156/357 |
| 4,892,297 | A * | 1/1990 | Kobler | 270/38 |
| 4,948,112 | A | 8/1990 | Sato et al. | |
| 5,915,319 | A * | 6/1999 | Price et al. | 112/470.16 |
| 6,019,714 | A * | 2/2000 | Stab | 493/429 |
| 6,110,093 | A * | 8/2000 | Slusarz | 493/416 |
| 6,454,692 | B2 | 9/2002 | Ganneval et al. | |
| 6,546,867 | B1 * | 4/2003 | Franklin et al. | 101/378 |
| 6,827,013 | B2 * | 12/2004 | Richards | 101/227 |

FOREIGN PATENT DOCUMENTS

| | | |
|---|---|---|
| JP | 64-24054 | 2/1989 |
| JP | 7-61704 | 3/1995 |
| JP | 2532507 | 6/1996 |
| JP | 11-310366 | 11/1999 |
| JP | 2001-233545 | 8/2001 |
| JP | 2001-524435 | 12/2001 |
| JP | 2002-302289 | 10/2002 |
| JP | 2003-118930 | 4/2003 |
| JP | 2003-231236 | 8/2003 |

* cited by examiner

CONTROL OF SPEED CHANGE BELTS (V : BELT SPEED
t : TIME)

FOLDER FOR ROTARY PRESS

RELATED APPLICATIONS

The present application is based on International Application PCT/JP2004/18294, and claims priority from, Japanese Application Number 2003-415124, filed Nov. 18, 2003, the disclosure of which is hereby incorporated by reference herein in its entirety.

TECHNICAL FIELD

The disclosed embodiments relates to a folding machine installed in a rotary printing machine, and more particularly to a folding machine that is employed in a variable cut-off length type rotary printing machine in which the cut-off length of a web can be varied.

BACKGROUND ART

FIG. 22 is a schematic diagram showing an example of a commercial offset type rotary printing machine that is one of the rotary printing machines, FIG. 23 is a schematic diagram showing an example of a folding machine (comprising a web cutting unit and a paper discharger) adopted in the commercial offset type rotary printing machine, and FIG. 24 is a schematic diagram for explaining an example of the catching-folding unit of the folding machine.

As shown in FIG. 22, an ordinary commercial offset type rotary printing machine comprises eight major parts: a paper feeder part 1; an infeed part 2; a printing part 3; a drying part 4; a cooling part 5; a web passing part 6; a folding machine 7; and a paper discharger part 8 for discharging a sheet folded in the folding machine 7 outside the machine. In the paper feeder part 1, a new web roll 1*b* is waiting for being used next to a web roll 1*a* being used. The printing part 3 is equipped with a number of printing units that corresponds to the number of print colors. In this example, it is equipped with four printing units 3*a* to 3*d*.

As shown in FIG. 23, the folding machine 7 and paper discharger part 8 comprise a drag roller 11, a triangular plate 12, a pair of lead-in rollers 13*a* and 13*b*, a pair of nipping rollers 14*a* and 14*b*, a web cutting unit 20, an accelerating belt conveyor 30, a catching-folding unit 40B, a paper discharge belt conveyor 46, a sheet alignment stacker 80 (see FIG. 22), and so forth.

A further description will be given of the construction and function of each part. The triangular plate 12 folds the web 10 fed through the drag roller 11, in half along the traveling direction, and the web 10 folded in two is fed through the lead-in rollers 13*a* and 13*b*. The downstream nipping rollers 14*a* and 14*b* nip the web 10 folded in two, convey it while rotating, and press it between them to put a vertical crease in it reliably.

The web cutting unit 20 is used to cut the web 10 folded in two at a predetermined cut-off length position and consists of a saw cylinder 21 and a receiving cylinder 22 rotating in opposite directions. The saw cylinder 21 is provided with a saw-blade holder 24 having saw blades 23 in the outer periphery along the axial direction. The receiving cylinder 22 is provided with a rubber bed 25, made of an elastic body such as rubber, for receiving the saw blades 23.

The saw blades 23 of the saw cylinder 21 and the rubber bed 25 of the receiving cylinder 22 are arranged so that they mesh with each other. By synchronously rotating them in opposite directions, a sheet (folded sheet) 10*a* is cut off from the fed web 10 by cutting it in the horizontal direction (direction of the width of the web 10). In this example, the saw cylinder 21 is provided with a single saw blade 23 and the receiving cylinder 22 is provided with a single rubber bed 25. Therefore, if each of the cylinders 21, 22 makes one rotation, cutting is performed once.

The accelerating belt conveyor 30 is equipped with a pair of conveyor belts 31, 32 facing each other. Each of the conveyor belts 31, 32 passes around guide rollers 33 and is constructed such that the traveling speed can be arbitrarily varied to some degree. The conveyor belts 31, 32 receive the sheet 10*a* cut off from the continuous web 10 by the web cutting unit 20 and nip it between them. The moment the sheet 10*a* is nipped, it is conveyed to the catching-folding unit 40B at the speed corresponding to the speed of the catching-folding unit 40B.

As shown in FIG. 24, the catching-folding unit 40B consists of a catching cylinder 42 equipped with catchers 41, and a folding cylinder 45 equipped with gripper tools (hereinafter referred to simply as grippers) 43 and folding blades 44. The front end of the sheet 10*a* fed through the conveyor belts 31, 32 is gripped by the grippers 43, and when the sheet 10*a* is being rotated and transferred, the folding blade 44 of the folding cylinder 45 engages with the catcher 41 of the catching cylinder 42. At the position of the engagement, the sheet 10*a* transferred to the catcher 41 is folded along a crease perpendicular to the conveying direction.

In the illustrated catching-folding unit 40B, the catching cylinder 42 has two catchers 41 and the folding cylinder 45 has two grippers 43 and two folding blades 44. As a result, two folded sheets 10*b* are formed in one rotation of each of the cylinders 42, 45.

The paper discharge belt conveyor 46 is constructed such that the folded sheets 10*b*, formed as described above, are transferred to the subsequent steps, that is, a sheet alignment stacker 80 (see FIG. 22), etc. For instance, as shown in FIG. 22, in the sheet alignment stacker part, the folded sheets 10*b* may be fed into a stacker (not shown) by transferring them onto a vane wheel 81 and then delivering them onto a paper discharge belt conveyor 82.

In the aforementioned construction, when cutting off a predetermined cut-off length from the printed continuous web 10 by the saw cylinder 21, the predetermined cut-off length C is given as $$C=Vo/(Nc\cdot n)$$

where Vo is the traveling speed (conveying speed) of the web, Nc is the number of rotations of the saw cylinder, and n is the number of saw blades.

The cut-off sheet 10*a* is accelerated in one breath from the traveling speed of the web 10 to the speed Vb (i.e., the peripheral speed of the folding cylinder 45) of the catching-folding unit 40B and transferred onto the folding cylinder 45 at the traveling speed Vb.

Subsequently, the sheet 10*a* fed from the conveyor belts 31, 32 is delivered to the gripper 43 of the folding cylinder 45 and catching and folding are carried out.

A folding machine capable of varying the cut-off length of a web (i.e., a folding machine for a variable cut-off length type rotary printing machine) is disclosed in Patent Document 1 by way of example. This folding machine is provided with a cut-off cylinder, and a delivering cylinder for cutting a ribbon (web) into folded sheets having the desired cut-off length in cooperation with the cut-off cylinder. This delivering cylinder has a cylinder center line and a peripheral surface region. The peripheral surface region of the delivering cylinder has an adjustable diameter portion arranged thereon. This adjustable diameter portion is connected to the delivering cylinder and is movable toward and away from the cylinder center line to adjust the desired cut-off length of a folded sheet. In addition, there is provided a jaw cylinder, which has a cylinder jacket and jaws provided in this cylinder jacket. Furthermore, the peripheral surface region of the delivering cylinder has a pushing blade for folding a folded sheet into the jaws in cooperation with the jaws so that the cut-off length of a web can be varied.

In addition to the catching-folding unit 40B consisting of the catching cylinder 42 equipped with catchers 41 and the folding cylinder 45 equipped with the gripper 43 and folding blades 44 for folding a sheet is a folder, which employs a chopper, such as a chopper folder disclosed in Patent Document 2.

Patent Document 1: Japanese Laid-Open Patent Publication No. 2001-233545

Patent Document 2: Japanese Patent Publication No. 2532507

DISCLOSED EMBODIMENT

However, the conventional folding machine for a rotary printing machine such as that shown in FIGS. 22 to 24 has the following problems when varying the cut-off length of the web 10.

That is, in the aforementioned conventional folding machine, the accelerating belt conveyor 30 operates at uniform velocity so that the sheet 10*a* is conveyed at the conveying speed Vb (peripheral speed of the folding cylinder 45) of the catching-folding unit 40B higher than the traveling speed Vo of the web 10. Because of this, when the sheet 10*a* is delivered from the web cutting unit 20 to the accelerating belt conveyor 30 immediately after it is cut off by the web cutting unit 20, the sheet 10*a* being traveled at the traveling speed Vo of the web 10 is accelerated in one breath to the speed Vb higher than the speed Vo when received by the accelerating belt conveyor 30.

Therefore, even a slight shift in the cut-off completion timing in the web cutting unit 20 can cause a shift in the timing at which the sheet 10*a* is delivered from the web cutting unit 20 to the variable speed belt conveyor 30. This can cause a shift in the timing at which the sheet 10*a* is delivered from the variable speed belt conveyor 30 to the catching-folding unit 40B, so it is fairly difficult to ensure sufficient accuracy of folding (accuracy of folding position or folding phase).

Particularly, accumulation of the aforementioned shifts in the timing can cause not only a reduction in accuracy of folding but also incomplete delivery between the accelerating belt convey or 30 and the catching-folding unit 40B, so that there are cases where the folding machine has to be shut down.

The disclosed embodiment has been made in view of the problems mentioned above. Accordingly, it is the object of the disclosed embodiment to provide a folding machine for a rotary printing machine that is capable of performing a folding process (such as putting a crease in a cut-off sheet in a direction perpendicular to the travel direction) on a cut-off sheet with a high degree of accuracy.

MEANS FOR SOLVING THE PROBLEMS

To achieve the aforementioned object, a folding machine of the disclosed embodiment is provided downstream of a printing unit of a rotary printing machine. The folding machine includes a cut-off unit. This cut-off unit comprises a cut-off mechanism for cutting off a sheet at a predetermined cut-off length position from a web fed from the printing unit, and a first belt conveyor comprising a pair of conveyor belts for nipping and conveying the sheet cut off by the cut-off mechanism. The folding machine further includes a processor, provided downstream of the cut-off unit, for processing the sheet cut off by the cut-off unit, and a second belt conveyor provided between the cut-off unit and the processor and comprising at least one pair of conveyor belts for receiving the sheet conveyed by the first belt conveyor and conveying the sheet to the processor. The aforementioned second belt conveyor varies a sheet conveying speed during the conveyance of the sheet so that in receiving the sheet from the first belt conveyor, the sheet conveying speed becomes approximately equal to a first speed at which the sheet is conveyed in the first belt conveyor, and in conveying the sheet to the processor, the sheet conveying speed becomes approximately equal to a second speed at which the sheet is conveyed in the processor.

Preferably, the aforementioned cut-off unit is constructed such that it can vary and cut a cut-off length of the web fed from the printing unit; a speed at which the web is conveyed is set according to a cut-off length of the sheet that is cut off by the cut-off unit; and the first speed at which the sheet is conveyed in the first belt conveyor is set so that it becomes equal to the web conveying speed.

Preferably, the aforementioned cut-off unit comprises a first cut-off mechanism for partially cutting the web, and a second cut-off mechanism, provided downstream of the first cut-off mechanism, for cutting off the sheet from the web by cutting the uncut portions of the web that is not cut by the first cut-off mechanism.

Preferably, the aforementioned first belt conveyor nips the web that is cut by the second cut-off mechanism, and the folding machine further includes a fourth belt conveyor comprising a pair of conveyor belts for nipping and conveying the web to the first cut-off mechanism.

Preferably, the folding machine further includes a first relative-phase changer, interposed between the first cut-off mechanism and the second cut-off mechanism, for changing relative phases of rotation of the first cut-off mechanism and the second cut-off mechanism when varying a cut-off length of the web fed from the printing unit.

Preferably, the folding machine further includes a scored-line forming mechanism, provided upstream of the first and second cut-off mechanisms, for forming a horizontally scored line in the web at a predetermined position; and a second relative-phase changer, interposed between the scored-line forming mechanism and the first cut-off mechanism, for changing relative phases of rotation of the scored-line forming mechanism and the first cut-off mechanism when varying a cut-off length of the web fed from the printing unit.

The sheet conveying speed of the processor is preferably faster than that of the first belt conveyor.

In this case, preferably, the aforementioned second belt conveyor receives the sheet at a speed approximately equal to the sheet conveying speed of the first belt conveyor, then accelerates the sheet conveying speed to a speed approximately equal to the sheet conveying speed of the processor, then delivers the sheet to the processor at a speed approximately equal to the sheet conveying speed of the processor, and decelerates the sheet conveying speed to the sheet conveying speed of the first belt conveyor and receives a sheet next cut off from the web.

The aforementioned processor preferably comprises a discharger for discharging a sheet cut off by the cut-off unit or a folder for folding a sheet cut off by the cut-off unit along a crease perpendicular to a sheet conveying direction.

Preferably, the aforementioned folder comprises a catching cylinder equipped with a catcher, and a folding cylinder equipped with a gripper for holding the sheet and a folding blade for causing the catcher to catch the sheet; and the aforementioned folding cylinder is equipped with a first frame that supports the gripper and rotates on an axis of the folding cylinder, a second frame that supports the folding blade and rotates on the axis of the folding cylinder, and a third relative-phase changer for changing relative phases of rotation of the first and second frames.

Preferably, the aforementioned first belt conveyor, the aforementioned second belt conveyor, the aforementioned cut-off unit, and the aforementioned processor are respectively driven by different motors, and a phase of each of the motors can be relatively varied.

Preferably, the folding machine further includes an abutting portion, provided between the second belt conveyor and the processor, which a front end of the sheet abuts and by which a conveying phase of the sheet in the folder can be adjusted.

Preferably, the folding machine further includes a third belt conveyor, provided downstream of the second belt conveyor and at an entrance portion to the processor, which comprises a pair of conveyor belts for receiving the sheet from the second belt conveyor and conveying the sheet to the processor at the sheet conveying speed of the processor.

Preferably, the folding machine further includes a non-circular roller (cam roller), provided at a position where the sheet is delivered from one of the two belt conveyors adjacent to each other to the other of the two belt conveyors, which guides one of a pair of conveyor belts and has a plurality of surface portions in which distances from a center of rotation to the surface portions are different.

Preferably, the conveyor belts of the second belt conveyor are driven by non-circular rollers (cam rollers) having a plurality of surface portions in which distances from a center of rotation to the surface portions are different.

A second folding machine of the disclosed embodiment is provided downstream of a printing unit of a rotary printing machine. The second folding machine includes a cut-off unit capable of varying a cut-off length of a web fed from the printing unit and cutting off a sheet from the web; and a folder, provided downstream of the cut-off unit, for folding the sheet cut off from the web by the cut-off unit along a crease perpendicular to a sheet conveying direction. The aforementioned cut-off unit has a first cut-off mechanism for partially cutting the web at a predetermined cut-off length position, a belt conveyor for nipping and conveying the web partially cut by the first cut-off mechanism, and a second cut-off mechanism for cutting off a sheet with a predetermined cut-off length by cutting uncut portions of the web conveyed by the belt conveyor. The aforementioned folder is provided downstream of the belt conveyor and comprises a pair of folding rollers and a chopper folder for chopper-folding the sheet in cooperation with the folding rollers by moving into a space between the folding rollers.

A variable cut-off length type rotary printing machine of the disclosed embodiment comprises any one of the aforementioned folding machines and is constructed such that it can vary and cut a cut-off length of a printed web.

ADVANTAGES OF THE INVENTION

According to the folding machine (and the variable cut-off length type rotary printing machine) of the disclosed embodiment, a sheet is cut off by the cut-off unit from a web fed from the printing unit of a rotary printing machine and is conveyed to a downstream processor by first and second belt conveyors and processed. In the printing unit and cut-off unit, the web is conveyed at a fixed speed and printing and cutting are performed. The cut-off sheet is conveyed by the first belt conveyor and is further delivered to the second belt conveyor. The second belt conveyor varies a sheet conveying speed during the conveyance of the sheet so that in receiving the sheet from the first belt conveyor, the sheet conveying speed becomes approximately equal to a first speed at which the sheet is conveyed in the first belt conveyor, and in conveying the sheet to the processor, the sheet conveying speed becomes approximately equal to a second speed at which the sheet is conveyed in the processor. Therefore, the sheet cut off by the cut-off unit is delivered at an equal speed when delivering the sheet from the first belt conveyor to the second belt conveyor and when delivering the sheet from the second belt conveyor to the processor. As a result, sheets cut off from the web can be processed with a high degree of accuracy.

Particularly, in a rotary printing machine (variable cut-off length type rotary printing machine) constructed such that it can vary and cut a cut-off length of a web fed from the printing unit, if a speed at which the web is conveyed is set according to a cut-off length of a sheet that is cut off by the cut-off unit, and the first speed at which the sheet is conveyed in the first belt conveyor is set so that it becomes equal to the web conveying speed, the cut-off length of the web can be properly varied. In addition, as set forth above, the second belt conveyor varies a sheet conveying speed during the conveyance of the sheet so that in receiving the sheet from the first belt conveyor, the sheet conveying speed becomes approximately equal to a first speed at which the sheet is conveyed in the first belt conveyor, and in conveying the sheet to the processor, the sheet conveying speed becomes approximately equal to a second speed at which the sheet is conveyed in the processor. Therefore, the sheet cut off by the cut-off unit is delivered at an equal speed when delivering the sheet from the first belt conveyor to the second belt conveyor and when delivering the sheet from the second belt conveyor to the processor. Thus, a sheet can be cut to a predetermined cut-off length and the cut-off sheet can be accurately processed. This contributes to an enhancement in print quality.

Furthermore, the aforementioned cut-off unit may be constructed such that it includes a first cut-off mechanism for partially cutting a web and a second cut-off mechanism, provided downstream of the first cut-off mechanism, for cutting off a sheet from the web by cutting uncut portions of the web other than the portions cut by the first cut-off mechanism. In this case, in the cut-off unit, the web is partially cut at a predetermined cut-off length position by the first cut-off mechanism. Thereafter, while this web is being nipped and conveyed by the first belt conveyor, a sheet with a predetermined cut-off length is cut off by cutting uncut portions of the web with the second cut-off mechanism. Therefore, cutting of the web can be performed in a stable state of conveyance and the cut-off sheets can be easily conveyed at the required phase timing. As a result, cutting of the web and processing of cut-off sheets can be performed with a high degree of accuracy.

In this case, if the aforementioned first belt conveyor nips the web that is cut by the second cut-off mechanism, and the folding machine further includes a fourth belt conveyor comprising a pair of conveyor belts for nipping and conveying the web to the first cut-off mechanism, the web can be stably and accurately cut by the first cut-off mechanism.

It is preferable that a first relative-phase changer be interposed between the first cut-off mechanism and the second cut-off mechanism, for changing relative phases of rotation of the first cut-off mechanism and the second cut-off mechanism when varying a cut-off length of the web fed from the printing unit.

It is preferable that a scored-line forming mechanism be provided upstream of the first and second cut-off mechanisms, for forming a horizontally scored line in the web at a predetermined position, and it is also preferable that a second relative-phase changer be interposed between the scored-line forming mechanism and the first cut-off mechanism, for changing relative phases of rotation of the scored-line forming mechanism and the first cut-off mechanism when varying a cut-off length of the web fed from the printing unit.

It is preferable that the sheet conveying speed of the processor be faster than that of the first belt conveyor. In this case, the second belt conveyor receives the sheet at a speed approximately equal to the sheet conveying speed of the first belt conveyor, then accelerates the sheet conveying speed to a speed approximately equal to the sheet conveying speed of the processor, then delivers the sheet to the processor at a speed approximately equal to the sheet conveying speed of the processor, and decelerates the sheet conveying speed to the sheet conveying speed of the first belt conveyor and receives a sheet next cut off from the web.

In the case where the processor is used as a discharger for discharging a sheet cut off by the cut-off unit, the sheet can be discharged at an appropriate phase or position. When the processor is used as a folder for folding a sheet cut off by the cut-off unit along a crease perpendicular to a sheet conveying direction, the sheet can be folded at an appropriate phase or position by the folder.

In this case, the aforementioned folder preferably includes a catching cylinder equipped with a catcher, and a folding cylinder equipped with a gripper for holding the sheet and a folding blade for causing the catcher to catch the sheet. The aforementioned folding cylinder is preferably equipped with a first frame that supports the gripper and rotates on an axis of the folding cylinder, a second frame that supports the folding blade and rotates on the axis of the folding cylinder, and a third relative-phase changer for changing relative phases of rotation of the first and second frames.

If the first belt conveyor, the second belt conveyor, the cut-off unit, and the processor are respectively driven by different motors, and a phase of each of the motors can be relatively varied, the speeds of components can be easily adjusted when a cut-off length is varied and the operating phases of components can be easily changed.

The folding machine may further include an abutting portion, provided between the second belt conveyor and the processor, which a front end of the sheet abuts and by which a conveying phase of the sheet in the folder can be adjusted. In this case, the sheet conveying phase in the folder can be properly adjusted.

The folding machine may further include a third belt conveyor, provided downstream of the second belt conveyor and at an entrance portion to the processor, which comprises a pair of conveyor belts for receiving the sheet from the second belt conveyor and conveying the sheet to the processor at the sheet conveying speed of the processor. In this case, the sheet can be delivered from the third belt conveyor to the folder at an equal speed and delivering of the sheet in this area can be stably performed.

The folding machine may further include a non-circular roller, provided at a position where the sheet is delivered from one of the two belt conveyors adjacent to each other to the other of the two belt conveyors, which guides one of a pair of conveyor belts and has a plurality of surface portions in which distances from a center of rotation to the surface portions are different. In this case, delivering of the sheet between two adjacent belt conveyors can be accurately performed.

Furthermore, the conveyor belts of the second belt conveyor may be driven by non-circular rollers having a plurality of surface portions in which distances from a center of rotation to the surface portions are different. In this case, although the non-circular rollers (cam rollers) rotate at a fixed speed, when the conveyor belts are driven by the surface portion in which the distance from the center of rotation is great they can be driven at a relatively high speed, and when the conveyor belts are driven by the surface portion in which the distance from the center of rotation is small, they can be driven at a relatively low speed. Therefore, the sheet conveying speed in the second belt conveyor can be easily varied from a first speed to a second speed.

According to a second folding machine and second variable cut-off length type rotary printing machine of the disclosed embodiment, the folder is constructed of a chopper folder. Therefore, when the printing unit and the cut-off unit are used in a variable cut-off length type rotary printing machine in which a cut-off length of a web can be varied, folding can be appropriately performed according to the cut-off length, if only folding timing is adjusted.

In the cut-off unit, the web is partially cut at a predetermined cut-off length position by the first cut-off mechanism. Thereafter, while the web partially cut by the first cut-off mechanism is being nipped and conveyed, a sheet with a predetermined cut-off length is cut off from the web by cutting uncut portions of the web with the second cut-off mechanism. Therefore, cutting of the web can be performed in a stable state of conveyance, cutting can be easily completed at the required timing, cut-off sheets can be easily conveyed at the required phase timing. As a result, cutting of the web and folding of cut-off sheets along a crease perpendicular to a web traveling direction can be performed with a high degree of accuracy.

BRIEF DESCRIPTION OF THE DRAWINGS

FIG. 13(*a*) being an end view showing the drive cam roller and FIGS. 13(*b*) to 13(*d*) being end views showing replaceable small-radius blocks;

DESCRIPTION OF REFERENCE NUMERALS

Figure 1:
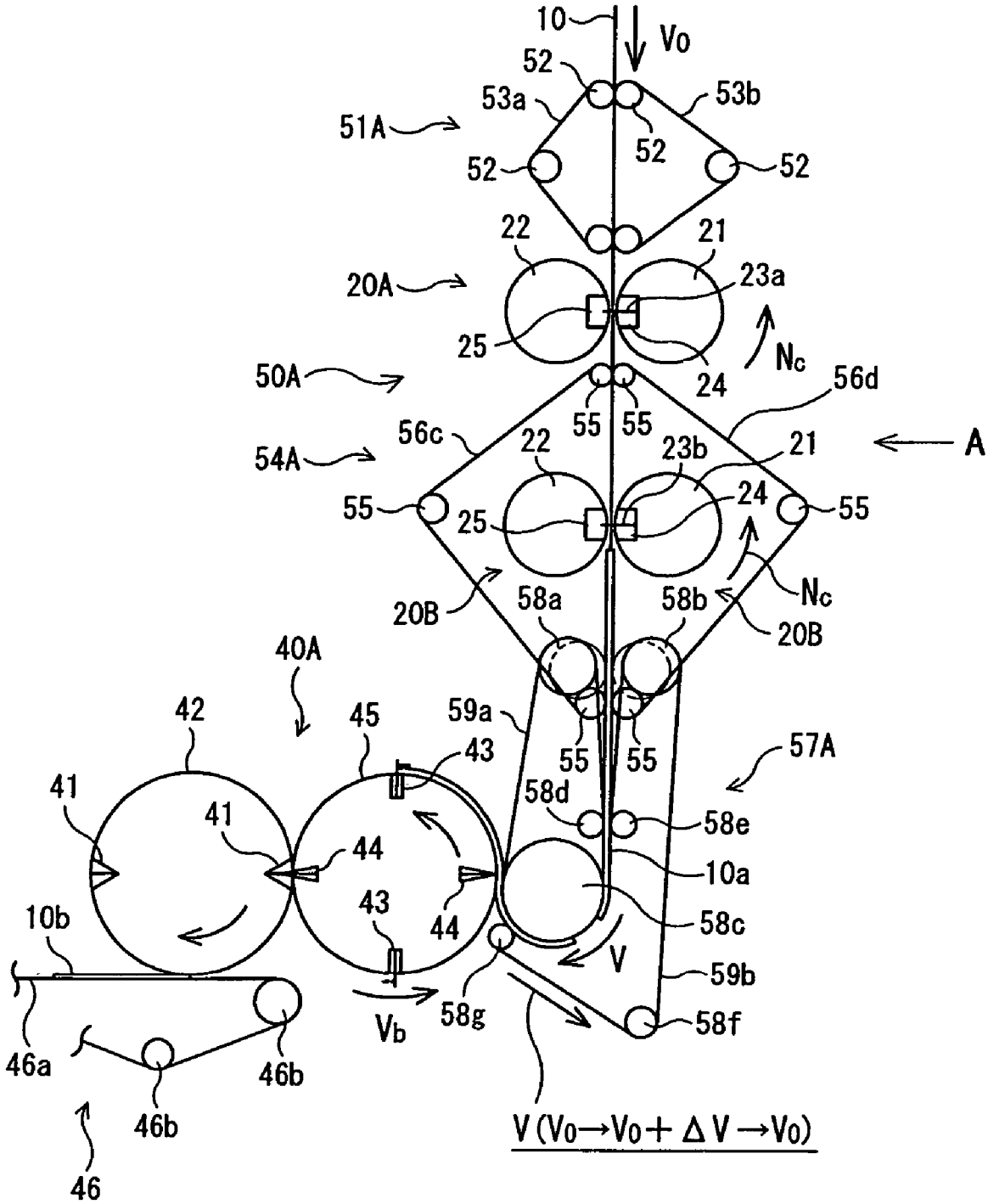
FIG. 1 is a schematic side view showing a folding machine for a rotary printing machine constructed in accordance with a first embodiment of the present invention.

1 Paper feeder part
1*a*, 1*b* Web roll
2 Infeed part
3 Printing part
3*a* to 3*d* Printing units
4 Drying part
5 Cooling part
6 Web passing part
7 Folding machine
8 Paper discharger part
11 Drag roller
12 Triangular plate
20A First cut-off mechanism
20B Second cut-off mechanism
21 Saw cylinder
22 Receiving cylinder
23*a*, 23*b* Blade (saw blade)
24 Saw holder
25 Rubber bed
40A, 40B, 90 Catching-folding unit
41, 91 Catcher
42, 92 Catching cylinder
43, 93 Gripper tool (gripper)
44, 94 Folding blade
45, 95. Folding cylinder
46 Paper discharge belt conveyor
50A, 50B, 50C Cut-off unit
51A, 51B, 51C Upstream belt conveyor (fourth belt conveyor)
54A, 54B, 75 Middle belt conveyor (first belt conveyor)
57A, 57B, 57C Downstream belt conveyor (second belt conveyor)
52, 55, 58*a* to 58*b*, 76, 76*a*, 76*b* Guide roller
53*a* to 53*f*, 59*a* to 59*f*, 77*a*, 77*b* Guide belt (conveyor belt)
56*a*, 56*b* Guide belt (variable speed conveyor belt)
60 Bottom belt conveyor (third belt conveyor)
63 Positioning cylinder
64 Nip roller
65*a* Low-speed cam roller
65*b*, 66 Variable speed cam roller
67, 68 High-speed cam roller
70 Non-circular drive roller (drive cam roller)
71 Large-radius portion
72 Small-radius portion
78*a*, 78*b* Folding roller
79 Chopper-folder
79*a* Chopper folding blade
80 Sheet alignment stacker
81 Vane wheel
84 Scored-line forming mechanism
89A, 89B, 99 Phase changer
96 First frame (first shell portion)
97 Second frame (second shell portion)

BEST MODE FOR CARRYING OUT THE EMBODIMENT

Embodiments of the present invention will hereinafter be described with reference to the drawings.

First Embodiment

Figure 2:
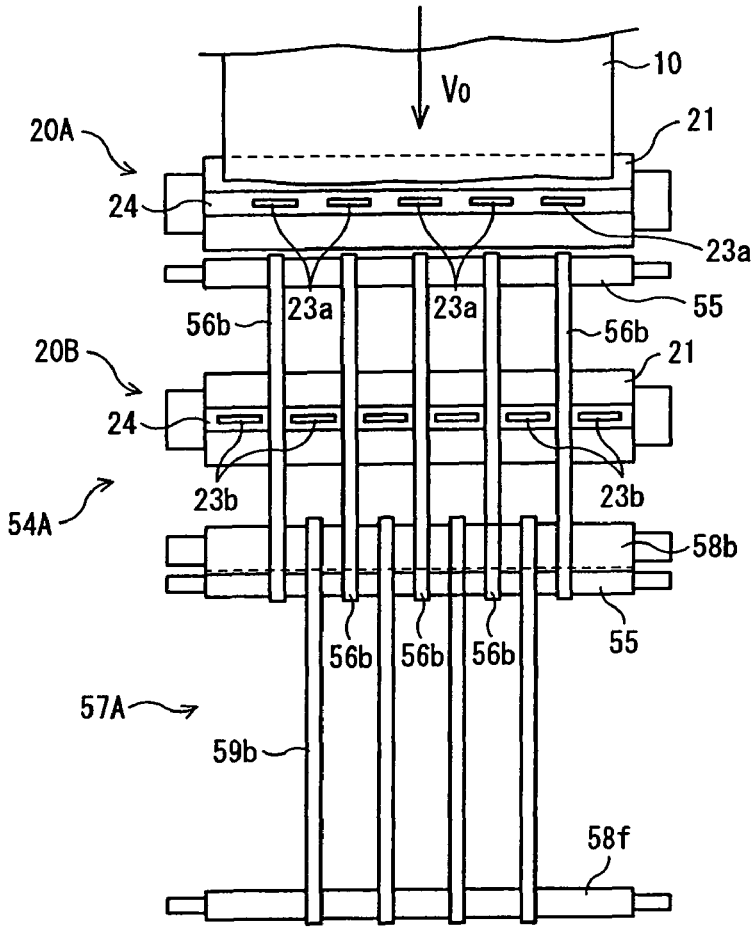
FIG. 2 is a schematic front view (taken in a direction indicated by an arrow A in FIG. 1) showing the essential parts of the folding machine of the first embodiment of the present invention.
Figure 3:
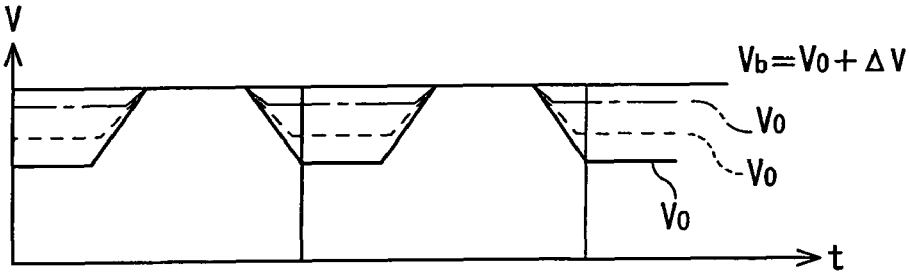
FIG. 3 is a speed characteristic diagram used to explain how control of speed change belts is performed in the folding machine of the first embodiment of the present invention.

Initially, a first embodiment of the disclosed embodiment will be described. FIGS. 1 to 3 show a folding machine for a rotary printing machine constructed in accordance with the first embodiment of the disclosed embodiment. FIG. 1 is a schematic side view showing the construction of the folding machine; FIG. 2 is a schematic front view (taken in a direction indicated by an arrow A in FIG. 1) showing the essential parts; and FIG. 3 is a speed characteristic diagram used to explain how control of speed change belts is performed. Note in FIGS. 1 and 2 that the same parts as those of the conventional example (FIGS. 22 to 24) are given the same reference numerals.

Figure 22:
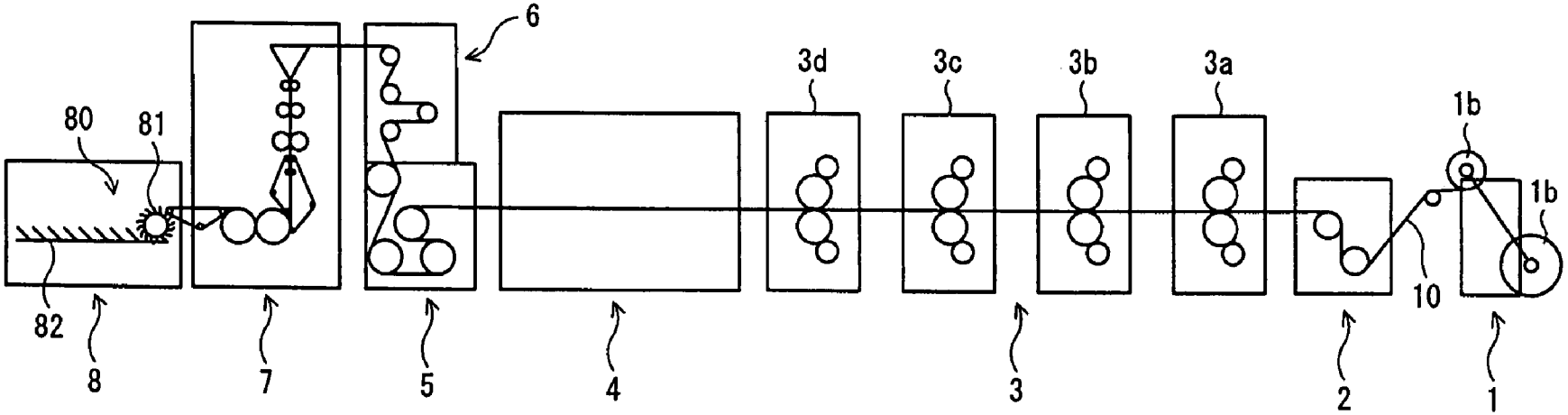
FIG. 22 is a schematic side view showing an ordinary commercial offset type rotary printing machine.

For example, as shown in FIG. 22, a rotary printing machine according to this embodiment comprises eight major parts: a paper feeder part 1; an infeed part 2; a printing part 3;

a drying part 4; a cooling part 5; a web passing part 6; a folding machine 7; and a paper discharger part 8 for discharging a sheet folded in the folding machine 7 outside the machine. In the paper feeder part 1, a new web roll 1*b* is waiting for being used next to a web roll 1*a* being used. The printing part 3 is equipped with a number of printing units that corresponds to the number of print colors. In this embodiment, it is equipped with four printing units 3*a* to 3*d*.

Note that the web conveying speed V0 in the paper feeder part 1, infeed part 2, printing part 3, drying part 4, cooling part 5, web passing part 6, and folding machine 7 is set according to the cut-off length of the web 10. For instance, in making the cut-off length relatively long, the web conveying speed V0 can be set to a relatively high speed. On the other hand, in making the cut-off length relatively short, the web conveying speed V0 can be set to a relatively low speed.

Figure 23:
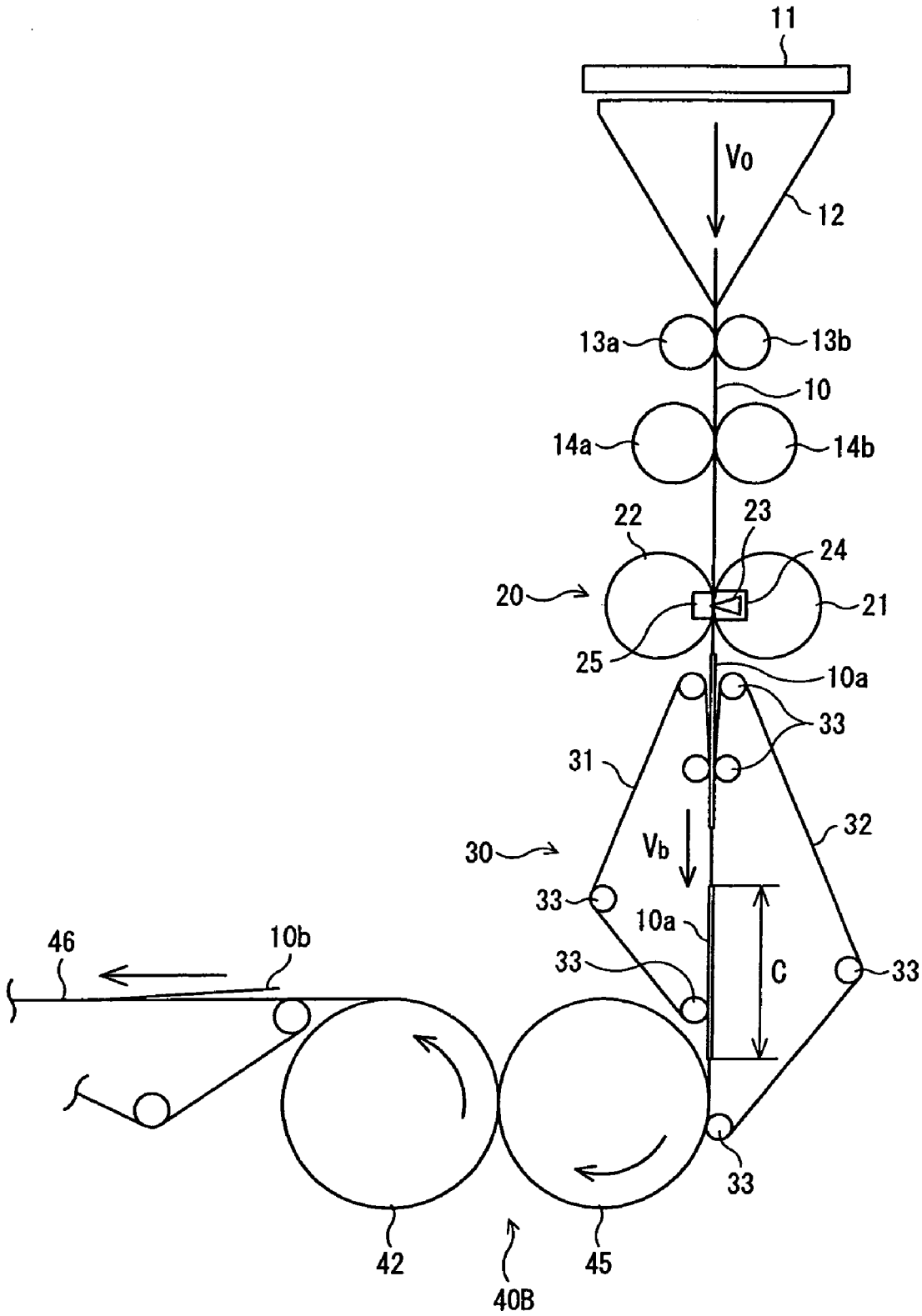
FIG. 23 is a schematic side view showing a conventional folding machine employed in the offset type rotary printing machine.
Figure 24:
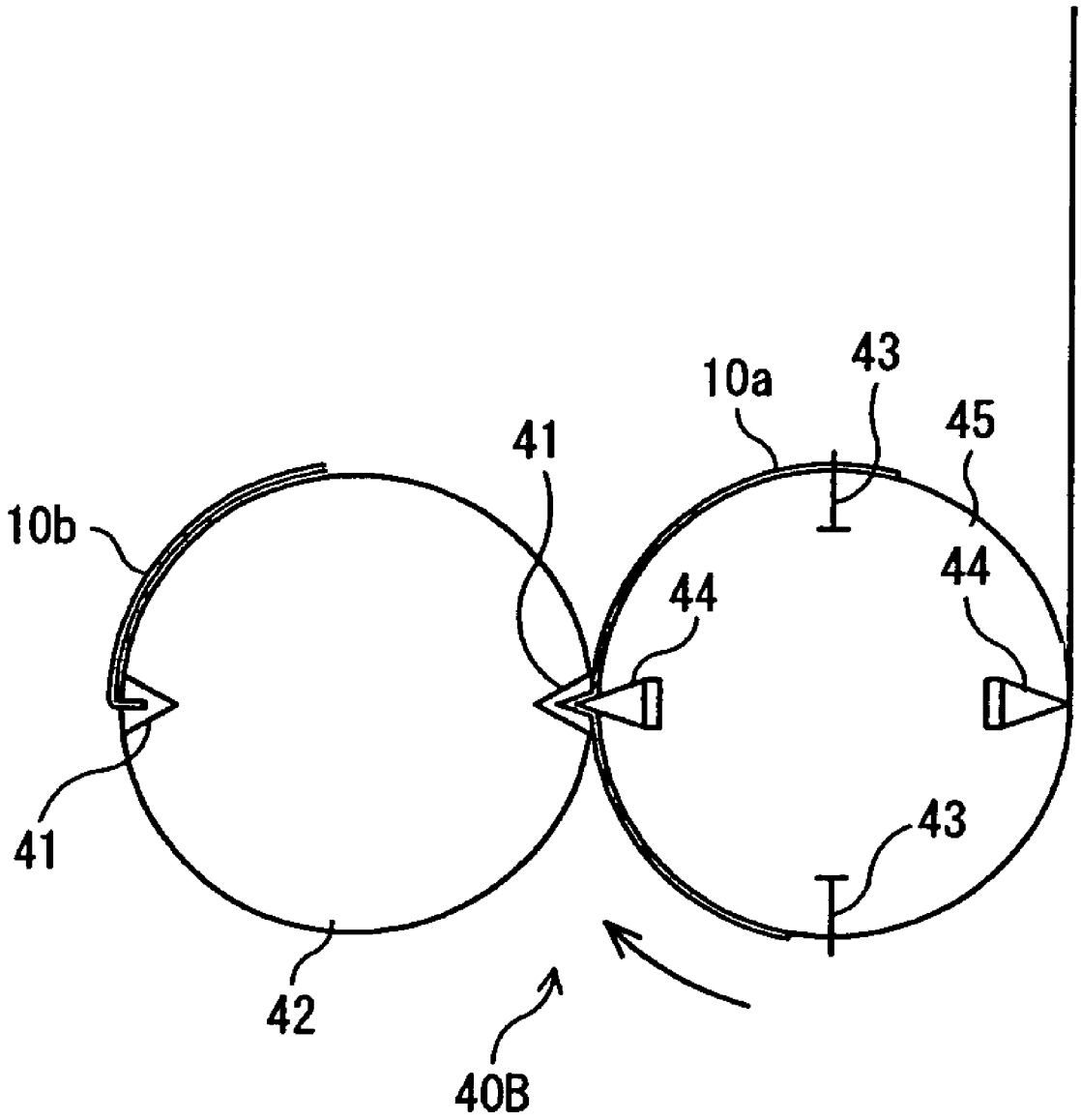
FIG. 24 is a schematic side diagram showing the essential parts of the conventional folding machine.

The folding machine 7 of this embodiment is disposed downstream of the drag roller 11 and triangular plate 12 (see FIG. 23). As shown in FIG. 1, from the upstream side, it is equipped with an upstream belt conveyor (fourth belt conveyor) 51A, a first cut-off mechanism 20A, a middle belt conveyor (first belt conveyor) 54A and a second cut-off mechanism 20B, a downstream belt conveyor (second belt conveyor) 57A, a catching-folding unit 40A for processing a cut-off sheet, and a paper discharge belt conveyor 46. The first cut-off mechanism 20A, middle belt conveyor 54A, and second cut-off mechanism 20B constitute a cut-off unit 50A for cutting off a sheet with a predetermined cut-off length from the web 10.

The upstream belt conveyor 51A comprises a pair of endless guide belts (also called conveyor belts or nipping belts) 53*a*, 53*b*, which are driven by a plurality of guide rollers 52. The upstream belt conveyor 51A nips the web 10, folded in two and fed by the triangular plate 12, between the guide belts 53*a*, 53*b* and conveys it at a speed equal to the upstream web conveying speed V0. Although not shown, each of the guide belts 53*a*, 53*b* comprises a plurality of belts disposed parallel to each other in the direction of the width of the web 10.

The first cut-off mechanism 20A is a mechanism for partially cutting the web 10 folded in two at a predetermined cut-off length position and comprises a saw cylinder 21 and a receiving cylinder 22 rotating in opposite directions. The saw cylinder 21 is provided with a saw-blade holder 24 having saw blades 23*a* in the outer periphery along the axial direction. The receiving cylinder 22 is provided with a rubber bed 25, made of an elastic body such as rubber, for receiving the saw blades 23*a*. Particularly, as shown in FIG. 2, the saw blades 23*a* are arranged intermittently and used to partially cut the web 10 at a predetermined cut-off length position in the form of a scored line. This cutting is also called intermittent cutting.

The middle belt conveyor 54A comprises a pair of endless guide belts (also called conveyor belts or nipping belts) 56*a*, 56*b*, which are driven by a plurality of guide rollers 55. The middle belt conveyor 54A nips the web 10, cut at the predetermined cut-off length position in the form of a scored line and fed by the first cut-off mechanism 20A, between the guide belts 56*a*, 56*b* and conveys it at a speed equal to the upstream web conveying speed V0. As shown in FIG. 2, the guide belts 56*b* (or 56*a*) of the middle belt conveyor 54A are disposed parallel to one another and have a predetermined width or less. The guide belts are also disposed so that they correspond to the portions cut by the first cut-off mechanism 20A and does not extend laterally beyond the cut portions.

The second cut-off mechanism 20B is a mechanism for completing cutting by cutting uncut portions of the web 10, cut at the predetermined cut-off length position in the form of a scored line by the first cut-off mechanism 20A and conveyed by the belt conveyor 54A, and comprises a saw cylinder 21 and a receiving cylinder 22 rotating in opposite directions. The saw cylinder 21 is provided with a saw-blade holder 24 having saw blades 23*b* in the outer periphery along the axial direction. The receiving cylinder 22 is provided with a rubber bed 25, made of an elastic body such as rubber, for receiving the saw blades 23*b*. Note that the intermittent cutting phase of the first cut-off mechanism 20A is adjusted to coincide with that of the second cut-off mechanism 20B so that the intermittent cutting positions by the first cut-off mechanism 20A and the intermittent cutting positions by the second cut-off mechanism 20B are on a line when superimposed.

Particularly, as shown in FIG. 2, the saw blades 23*b* of the second cut-off mechanism 20B are arranged intermittently, as with the saw blades 23*a* of the first cut-off mechanism 20A. The saw blades 23*b* are shifted from the saw blades 23*a* in the direction of the width of the web 10 so that they can cut the uncut portions of the web 10 that is not cut by the first cut-off mechanism 20A. In this manner, the web 10 is completely cut at a predetermined cut-off length position. Each of the saw blades 23*b* is interposed between the guide belts 56*b* (or 56*a*) of the middle belt conveyor 54A, so there is no possibility that they will interfere with the guide belts 56*a*, 56*b*.

Thus, in the cut-off unit 50A, the fed web 10 is cut in a horizontal direction (perpendicular to the traveling direction) by the first and second cut-off mechanisms 20A, 20B and a sheet 10*a* is cut off from the web 10. In the example of this unit, single cutting is performed in one rotation of the saw cylinder 21 and receiving cylinder 22 of the first and second cut-off mechanisms 20A, 20B.

The downstream belt conveyor 57A, disposed downstream of the cut-off unit 50A, comprises a pair of endless guide belts (also called conveyor belts or nipping belts) 59*a*, 59*b*, which are driven by a plurality of guide rollers 58*a* to 58*b*. The sheet 10*a*, cut off at the predetermined cut-off length position by the second cut-off mechanism 20B, is nipped between the guide belts 59*a* and 59*b* and conveyed to the downstream catching-folding unit 40A from the middle belt conveyor 54. As shown in FIG. 2, the guide belts 59*b* (or 59*a*) of the downstream belt conveyor 57A have a predetermined width or less and are arranged parallel to each other. The guide belts 56*b* (or 56*a*) of the middle belt conveyor 54A and the guide belts 59*b* (or 59*a*) of the downstream belt conveyor 57A are alternately disposed.

In the middle belt conveyor 54A for receiving the sheet 10*a*, the sheet 10*a* is conveyed at a speed equal to the web conveying speed V0. In contrast to this, in the catching-folding unit 40A onto which the sheet 10*a* is delivered, the sheet 10*a* is conveyed at a speed different from the web conveying speed V0. Because of this, the downstream belt conveyor 57A is constructed as a variable speed belt conveyor or speed change belt conveyor so that the sheet 10*a* received at the conveying speed V0 is accelerated to a conveying speed Vb and delivered onto the catching-folding unit 40A.

In this embodiment, the middle belt conveyor 54A is equivalent to a first belt conveyor of the disclosed embodiment and the variable speed belt conveyor (downstream belt conveyor) 57A is equivalent to a second belt conveyor of the disclosed embodiment. As set forth above, in the variable speed belt conveyor (downstream belt conveyor) 57A that is the second belt conveyor, the speed in receiving the sheet 10*a* from the middle belt conveyor 54A (first belt conveyor) is a speed equal to the web conveying speed V0 and then the conveying speed is accelerated and the speed in delivering the sheet 10*a* onto the folding cylinder 45 of the catching-folding unit 40A is a speed equal to the sheet conveying speed Vb of the folding cylinder 45. In this case, the equal speed contains as light speed difference. That is, in receiving and delivering the sheet 10*a*, it is preferable to make the speed difference smaller, but if an error in the phase of conveying the sheet 10*a*, caused by a speed difference at the time of delivery, is within an allowable limit, such a speed difference is allowable. The same applies to the following second, third, and fifth embodiments.

In the variable speed belt conveyor 57A of this embodiment, the lower roller 58*c* of the guide belt 59*a* is a speed change roller for changing the speed of the guide belts 59*a*, 59*b*. By changing the speed of rotation of the speed change roller 58*c*, the speed of the guide belts 59*a*, 59*b* can be changed.

Note that in the downstream belt conveyor 57A, a pair of guide belts 59*a*, 59*b* are asymmetrically constructed such that the direction of the sheet 10*a* vertically conveyed by the cut-off unit 50A is changed to a horizontal direction according to the position of the catching-folding unit 40A. That is, while the guide belt 59*a* is guided and rotated mainly by an upper guide roller 58*a* and a lower guide roller 58*c*, the guide belt 59*b* is guided and rotated by the guide roller 58*c* through the guide belt 59*a* in addition to an upper guide roller 58*b* and lower guide rollers 58*f*, 58*g*. With this arrangement, the path of conveyance of the sheet 10*a* is changed at the guide roller 58*c* from the vertical direction to the horizontal direction where the catching-folding unit 40A is disposed.

The guide rollers 58*a*, 58*b*, disposed opposite each other, of the entrance portion of the downstream belt conveyor 57A are switched between sheet releasing positions indicated by solid lines and sheet nipping positions indicated by dashed lines, according to the speed of rotation of the speed change roller 58*c*. That is, when the sheet 10*a* is being conveyed at a speed higher than the web conveying speed by the downstream belt conveyor 57A, the guide rollers 58*a*, 58*b* are held in the sheet releasing positions. When the sheet 10*a* is being conveyed at a speed equal to the web conveying speed by the downstream belt conveyor 57A, the guide rollers 58*a*, 58*b* are held in the sheet nipping positions. This can prevent the occurrence of a speed difference at the time of the delivery of the sheet 10*a* from the middle belt conveyor 54A to the downstream belt conveyor 57A, so that the sheet 10*a* can be smoothly delivered without hindrance.

In this embodiment, the conveying speed V by the downstream belt conveyor 57A is changed during sheet conveyance, as shown in FIG. 3. In the stage of receiving the sheet 10*a*, the guide rollers 58*a*, 58*b* in the entrance portion are held in the sheet nipping positions so that the conveying speed V is made equal to the web conveying speed V0. Thereafter, the guide rollers 58*a*, 58*b* in the entrance portion are held in the sheet releasing positions so that the speed change roller 58*c* and guide belts 59*a*, 59*b* are accelerated to the speed Vb of the folding cylinder 45 by ΔV. After the sheet 10*a* is delivered to the gripper 43 of the folding cylinder 45, the speed Vb is returned to the original speed V0.

The catching-folding unit 40A, as with the conventional example, comprises a catching cylinder 42 equipped with catchers 41, and a folding cylinder 45 equipped with gripper tools (herein after referred to simply as grippers) 43 and folding blades 44. The front end of the sheet 10*a* fed through the variable speed belt conveyor 57A is gripped by the grippers 43, and when the sheet 10*a* is being rotated and transferred, the folding blade 44 of the folding cylinder 45 engages with the catcher 41 of the catching cylinder 42. At the position of the engagement, the sheet 10*a* transferred to the catcher 41 is folded along a crease perpendicular to the conveying direction. In this embodiment, the surface of the sheet 10*a* delivered from the downstream belt conveyor 57A onto the folding cylinder 45 is opposite to the conventional example (FIG. 23), so both the catching cylinder 42 and the folding cylinder 45 are constructed to rotate in a direction opposite to that of the conventional example. Because of this, the paper discharge belt conveyor 46 is disposed under the catching cylinder 42.

In the catching-folding unit 40A illustrated in FIG. 1, the catching cylinder 42 has two catchers 41 and the folding cylinder 45 has two grippers 43 and two folding blades 44. As a result, two folded sheets 10*b* are formed in one rotation of each of the cylinders 42, 45.

The paper discharge belt conveyor 46, as with the conventional example, is constructed such that the folded sheets 10*b* formed as described above are transferred to the subsequent steps, that is, a sheet alignment stacker 80 (not shown), etc. For instance, as shown in FIG. 22, in the sheet alignment stacker part, the folded sheets 10*b* may be fed into a stacker (not shown) by transferring them onto a vane wheel 81 and then delivering them on to a paper discharge belt conveyor 82.

The rotary printing machine in this embodiment, as with the conventional example, is constructed as a variable cut-off length type rotary printing machine that can vary the cut-off length of the web 10 by changing the outside diameter of the first and second cut-off mechanisms 20A, 20B as in a printing cylinder (e.g., a plate cylinder or blanket cylinder) of the printing part 4.

Therefore, as set forth above, in the folding machine 7, the cut-off length C is given as $$C=Vo/(Nc\cdot n)$$

where Vo is the traveling speed (conveying speed) of the web, Nc is the number of rotations of the saw cylinder, and n is the number of saw blades.

The cut-off sheet 10*a* is accelerated from the traveling speed of the web 10 to the speed Vb of the folding cylinder 45 and transferred onto the folding cylinder 45. Next, it is delivered to the gripper 43 of the folding cylinder 45 and catching and folding are carried out.

The folding machine according to the first embodiment of the disclosed embodiment is constructed as described above. Therefore, in the cut-off unit 50A, the web 10 fed at the predetermined web conveying speed Vo by the upstream belt conveyor 51A is intermittently cut in the form of a scored line at a predetermined cut-off length position by the first cut-off mechanism 20A. Thereafter, the web 10 is fed into the middle belt conveyor 54A, and when the web is being conveyed at the same speed as the web conveying speed Vo, the uncut portions of the web 10 are intermittently cut by the second cut-off mechanism 20B. In this manner, each sheet 10*a* is cut off from the web 10.

The cut-off sheet 10*a* is nipped by the middle belt conveyor 54A and transferred at the same speed as the web conveying speed Vo and is delivered to the downstream belt conveyor 57A. In receiving the sheet 10*a* by the downstream belt conveyor 57A, the guide rollers 58*a*, 58*b* in the entrance portion are held in the sheet nipping positions and operate at the same speed as the web conveying speed Vo. After the sheet 10*a* is received, the guide rollers 58*a*, 58*b* in the entrance portion are held in the sheet releasing positions, and the guide belts (speed change belts) 59*a*, 59*b* and the speed change roller 58*c* are accelerated to the sheet conveying speed Vb of the folding cylinder 45 by ΔV. After the sheet 10*a* is delivered to the gripper 43 of the folding cylinder 45 at the sheet conveying speed Vb, the speed Vb is returned to the original speed Vo.

If the sheet conveying speed becomes equal to the speed Vo, the guide rollers 58*a*, 58*b* in the entrance portion are held in the sheet nipping positions and the next sheet 10*a* is fed between the guide belts 59*a*, 59*b* of the downstream belt conveyor 57A. Like operations will hereinafter be repeated.

Note that a pattern of speed changes (Vo+ΔV), in addition to a speed change indicated by a solid line in FIG. 3, may include various patterns such as speed changes indicated by an alternate long and short dash line and a dashed line.

Since the folding machine of this embodiment is constructed as described above, it has the two following advantages:

(1) Since the sheet 10*a* is conveyed while it is being nipped by any one of the upstream, middle, and downstream belt conveyors 51A, 54A, and 57A, slippage of the sheet 1*a* is less liable to occur during conveyance and the sheet 10*a* can be delivered onto the folding cylinder 45 at accurate timing. Therefore, in addition to ensuring stable accuracy of folding, printed surfaces have no stain.

(2) The cut-off length of a web can be varied by varying the web conveying speed Vo and adjusting the speed change pattern of the speed change roller 58*c* and speed change belts 59*a*, 59*b*. This makes a large-capacity phase changer for a cylinder drive unit unnecessary. Therefore, in addition to a reduction in the space for the drive part, operations can be easily controlled and print quality becomes stable.

Note that a structure for varying the length of travel of each of the speed change belts 59*a*, 59*b* may be constructed so that it can cope with a variation in a phase due to a variation in the cut-off length of the web 10.

It is also possible to omit phase change rollers, and in addition to the illustrated belt layout, various belt layouts are possible.

Second Embodiment

Figure 4:
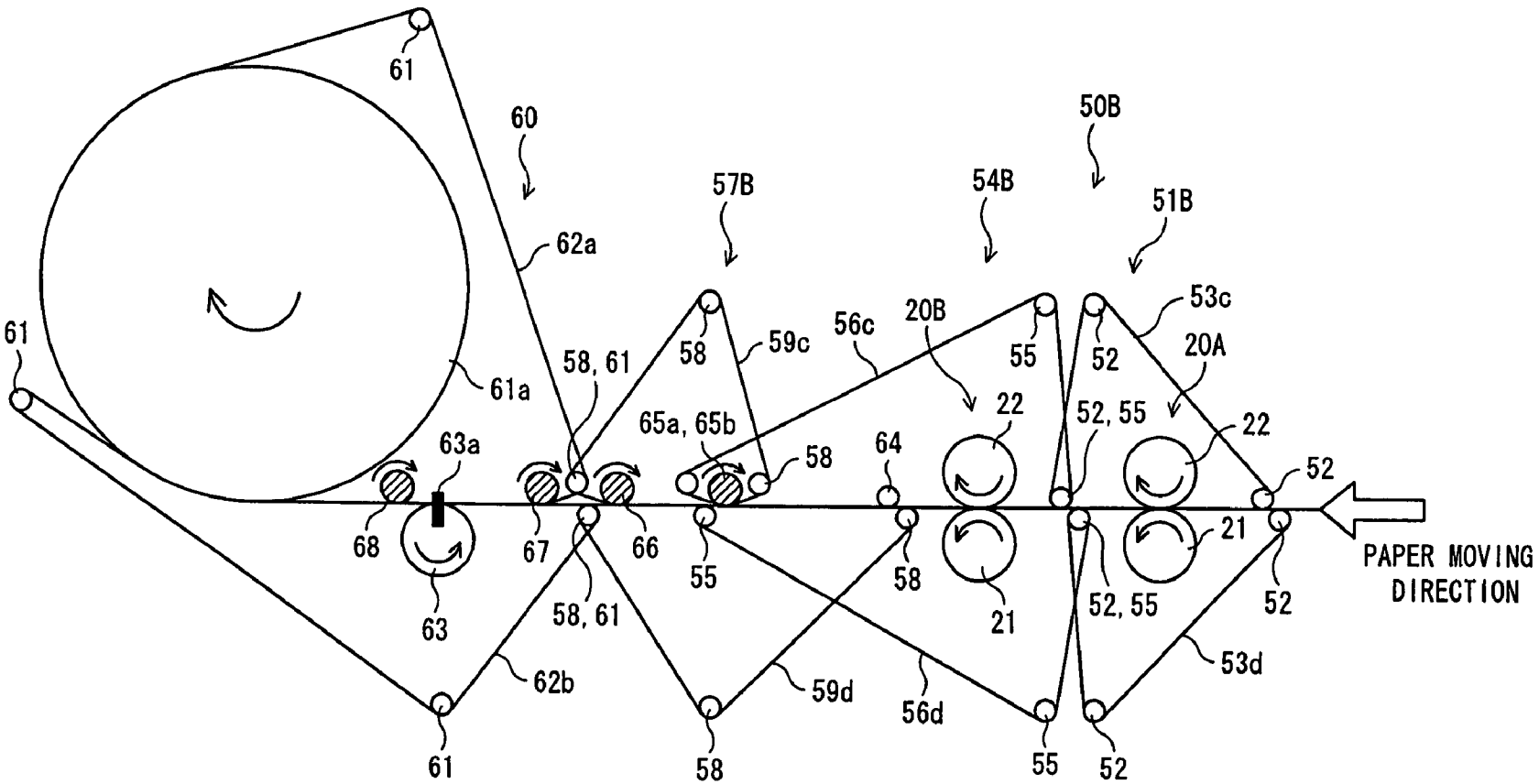
FIG. 4 is a schematic side view showing a folding machine for a rotary printing machine constructed in accordance with a second embodiment of the present invention.

Next, a second embodiment of the disclosed embodiment will be described. FIGS. 4 to 9 show a folding machine for a rotary printing machine constructed in accordance with the second embodiment of the disclosed embodiment. FIG. 4 is a schematic side view showing the essential parts of the folding machine and FIGS. 5 to 9 are schematic side views used to explain how a sheet 10*a* is delivered. Note in FIGS. 4 to 9 that the same parts as those of FIGS. 1 and 2 are given the same reference numerals and therefore a description of the same parts is partially omitted. In FIGS. 4 to 9, it is shown that a web 10 and a sheet 10*a* are horizontally conveyed. However, as with the first embodiment, they are conveyed in a vertical direction.

The folding machine 7 of this embodiment is disposed downstream of the drag roller 11 and triangular plate 12 (see FIG. 23). As shown in FIG. 4, as with the first embodiment, from the upstream side the folding machine 7 is equipped with an upstream belt conveyor (fourth belt conveyor) 51B, a first cut-off mechanism 20A, a middle belt conveyor (first belt conveyor) 54B and a second cut-off mechanism 20B, a downstream belt conveyor (second belt conveyor) 57B, a catching-folding unit (see reference numeral 40A in FIG. 1), and a paper discharge belt conveyor (see reference numeral 46 in FIG. 1). In addition to these, elements peculiar to this embodiment are added.

The upstream belt conveyor 51B comprises a pair of guide belts (also called nipping belts) 53*c*, 53*d* disposed opposite each other. The middle belt conveyor 54B comprises a pair of guide belts (also called nipping belts) 56*c*, 56*d* disposed opposite each other. The downstream belt conveyor 57B comprises a pair of guide belts (also called nipping belts) 59*c*, 59*d* disposed opposite each other. Each of the guide belts 53*c*, 53*d*, 56*c*, 56*d*, 59*c*, and 59*d* comprises a plurality of guide belts having a predetermined width or less and arranged parallel to each other. As with the first embodiment, the guide belts between the belt conveyors adjacent to each other in the web conveying direction are shifted in the width direction so that they do not interfere with each other. In the second embodiment, the upstream belt conveyor 51B is disposed between the upstream and downstream sides of the first cut-off unit 20A so that the first cut-off unit 20A is able to cut the web 10 that is held and conveyed by the upstream belt conveyor 51B.

Therefore, in this embodiment, the upstream belt conveyor 51B, first cut-off mechanism 20A, middle belt conveyor 54B, and second cut-off mechanism 20B constitute a cut-off unit 50B for cutting off a sheet 10*a* with a predetermined cut-off length from the web 10.

The upstream belt conveyor 51B nips the web 10 between guide belts 53*c*, 53*d* and conveys it at a speed equal to the upstream web conveying speed V0. Similarly, the middle belt conveyor 54B nips the web 10 between guide belts 56*c*, 56*d* and conveys it at a speed equal to the upstream web conveying speed V0.

In this embodiment, the downstream guide roller 52 of the upstream belt conveyor 51B and the upstream guide roller 55 of the middle belt conveyor 54B are coaxially disposed. Each of the guide belts 53*c*, 53*d* of the upstream belt conveyor 51B comprises a plurality of belts, regulated in width, which pass between the saw blades 23*a* of the first cut-off mechanism 20A and are disposed so that they do not interfere with the saw blades 23*a*.

Each of the guide belts shown in FIG. 4 comprises a plurality of narrow belts, and the guide belts shown so as to cross each other are shifted in the direction of the width of the web 10 so that they do not interfere with one another (see FIG. 2).

In the cut-off unit 50B, a sheet 10*a* with a predetermined cut-off length is cut off from the web 10 by intermittently cutting the web 10 with the first cut-off mechanism 20A and intermittently cutting the uncut portions of the web 10 with the second cut-off mechanism 20B.

The downstream belt conveyor 57B disposed downstream of the cut-off unit 50B receives the sheet 10*a* at the conveying speed V0, accelerates it from the conveying speed V0 to a conveying speed Vb, and delivers it to the downstream side. Thus, the downstream belt conveyor 57B is constructed as a variable speed belt conveyor.

Elements peculiar to this embodiment, as shown in FIG. 4, are a bottom belt conveyor (which is equivalent to a third belt conveyor of the disclosed embodiment) 60 provided downstream of the downstream belt conveyor 57B, a positioning cylinder 63, a nipping roller 64, a low-speed cam roller 65*a*, speed change cam rollers 65*b*, 66, and high-speed cam rollers 67, 68.

The bottom belt conveyor 60 comprises a pair of endless guide belts (conveyor belts) 62*a*, 62*b*, which are driven by a drive roller 61*a* and a plurality of guide rollers 61. The sheet 10*a* with a predetermined cut-off length, cut off by the cut-off units 20A, 20B and fed by the downstream belt conveyor 57B, is nipped between the guide belts 62*a*, 62*b* and it is conveyed at the conveying speed Vb and delivered to the catching-folding unit 40A.

In this embodiment, the downstream belt conveyor 57B conveys the sheet 10*a* linearly, but in the bottom belt conveyor 60, the guide belts 62*a*, 62*b* are asymmetrically constructed for the purpose of changing the direction of the vertically conveyed sheet 10*a* toward the catching-folding unit 40A horizontally. That is, the path of conveyance of the sheet 10*a*, which comprises the guide belts 62*a*, 62*b*, is formed by the downstream drive roller 62*a* so that the direction thereof is changed around the drive roller 62*a* from the vertical direction to the horizontal direction where the catching-folding unit 40A is disposed.

The positioning cylinder 63 is provided in the entrance portion of the bottom belt conveyor 60 that conveys the sheet 10*a* at the conveying speed Vb approximately equal to that of the catching-folding unit 40A, and has a stopper 63*a* that the front end of the sheet 10*a* abuts.

The nip roller 64 is provided on the reverse side of the guide belt 56*c* of the middle belt conveyor 54B. In this embodiment, the upstream guide roller 58 for guiding the guide belt 59*d* of the downstream belt conveyor 57B is disposed in the central portion of the middle belt conveyor 54B, and the nip roller 64 is disposed near the upstream guide roller 58. The nip roller 64 is pressed against the guide belt 59*c* to produce nip pressure between the guide belts 56*c*, 56*d* and between the guide belts 56, 59*d* so that the sheet 10*a* is reliably nipped.

In each of the cam rollers 65*a*, 65*b*, 66, 67, and 68, a plurality of surface portions, in which distances from the center of rotation to the outer peripheral surfaces are different, are smoothly continuous and pressure applied to a belt varies according to the outer peripheral surface that the belt abuts. Operations of the cam rollers 65*a*, 65*b*, 66, 67, and 68 will be described later.

Next, a description will be given of how each part is driven. A first motor (not shown) drives the folding cylinder 45, positioning roller 63, cam rollers 65*a*, 65*b*, 66, 67, and 68, bottom belt conveyor 60 (high-speed conveyor belts 62*a*, 62*b*); a second motor (not shown) drives the downstream belt conveyor 57B (speed change conveyor belts 59*c*, 59*d*); a third motor (not shown) drives the first and second saw cylinders 21, 21 (between them, there is a mechanical phase adjustment mechanism for making a phase adjustment when changing the cut-off length of a web); and a fourth motor (not shown) drives the upstream belt conveyor 51B and middle belt conveyor 54B (low-speed conveyor belt) at a speed of rotation corresponding to a web conveying speed. Thus, the parts are driven by individual motors, respectively. Therefore, the phase adjustment and speed change between units required when changing the cut-off length of a web can be easily performed without an intricate differential mechanism, etc.

Note that each of the cam rollers 65*a*, 65*b*, 66, 67, and 68 is forcibly driven to make one rotation when the saw cylinder makes one rotation.

The folding machine in the second embodiment of the disclosed embodiment is constructed as described above and the cut-off unit 50B performs intermittent cutting in two stages, as with the first embodiment. Thus, the second embodiment can obtain the same advantages as the first embodiment.

Particularly, this embodiment is characterized by the cam rollers 65*a*, 65*b*, 66, 67, and 68 and positioning roller 63, so a description will be give of the operations of the cam rollers 65*a*, 65*b*, 66, 67, and 68 and the positioning operation of the positioning cylinder 63.

As basic operations, a sheet 10*a* with a predetermined length is cut off by the saw cylinders 21 of the first and second cut-off mechanisms 20A and 20B, with the web 10 held by the low-speed conveyor belts of the upstream belt conveyor 51B and middle belt conveyor 54B, and the cut-off sheet 10*a* is further conveyed by the middle belt conveyor 54B and advances into the nipping area where the sheet 10*a* is nipped between the speed change belts 59*c*, 59*d* of the downstream belt conveyor 57B. In the downstream belt conveyor 57B, the nipped sheet 10*a* is accelerated to the speed of the high-speed belts 62*a*, 62*b* of the bottom belt conveyor 60. After being accelerated, the sheet 10*a* advances into the nipping area where the sheet 10*a* is nipped between the high-speed belts 62*a*, 62*b* of the bottom belt conveyor 60, and is supplied to the folding cylinder 45.

Figure 5:
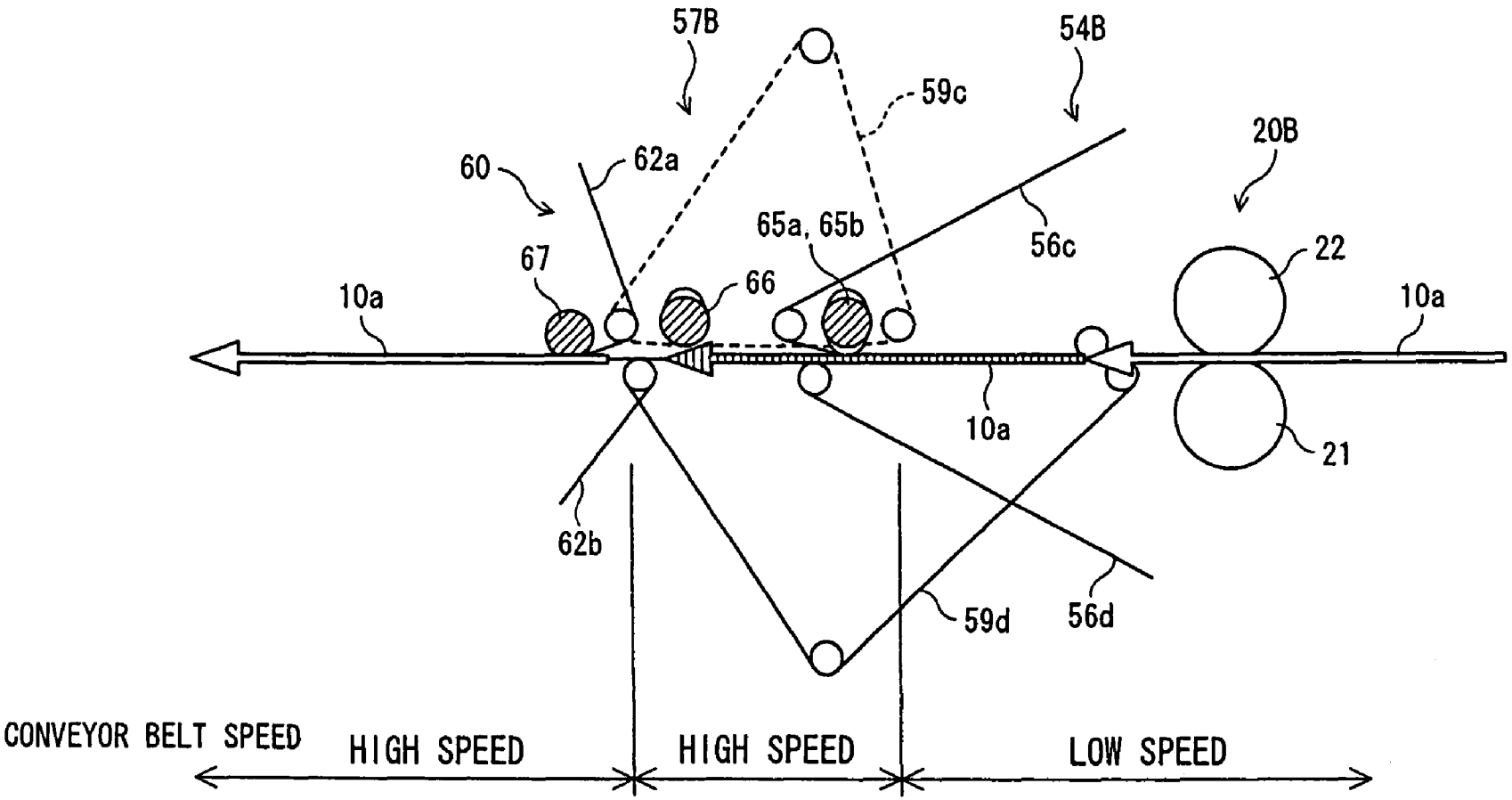
FIG. 5 is a schematic side view showing how a sheet is delivered by the folding machine of the second embodiment of the present invention.

In the aforementioned basic operations, as shown in FIG. 5, the sheet 10*a* is first held by the guide belts (low-speed conveyor belts) 56*c*, 56*d* of the middle belt conveyor 54B pushed down by the cam roller 65*a* and advances at a slow speed into the nipping area in which the sheet 10*a* is nipped between the guide belts (speed change conveyor belts) 59*c*, 59*d* of the downstream belt conveyor 57B. At this time, the speed change conveyor belts 59*c*, 59*d* rotate at the same speed as that of the guide belts (high-speed conveyor belts) 62*a*, 62*b*. That is, immediately after the sheet 10*a* going ahead is accelerated, the speed change conveyor belts 59*c*, 59*d* become equal to the speed of the high-speed conveyor belt. However, the speed change conveyor belt 59*c* is in contact with the small-radius portions of the cam rollers 65*b*, 66 and is at a position away from the speed change conveyor belt 59*d*. Thus, since the sheet 10*a* is not nipped, a difference in speed has no influence on the speed of the sheet 10*a*.

Figure 6:
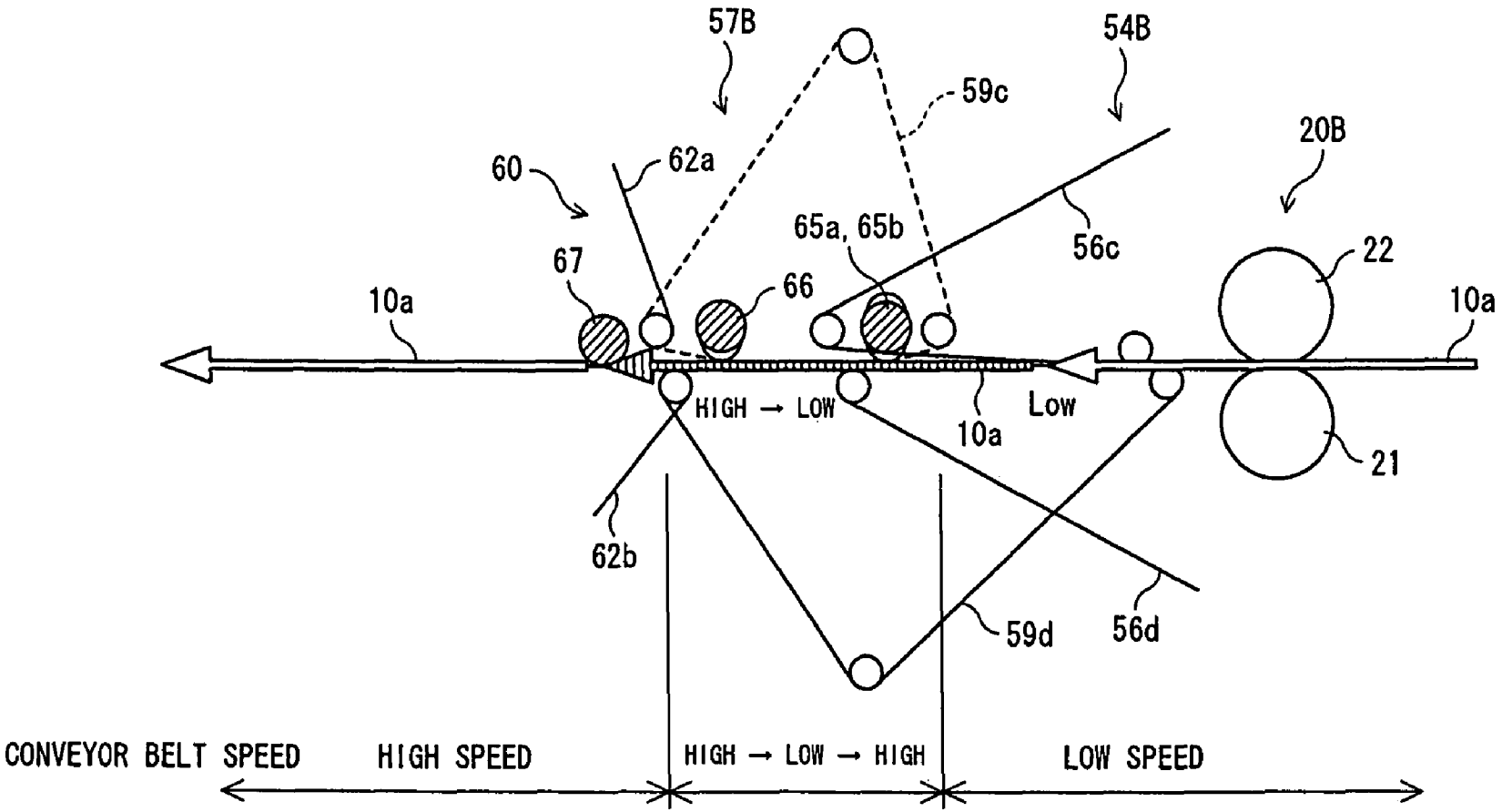
FIG. 6 is a schematic side view showing how a sheet is delivered by the folding machine of the second embodiment of the present invention.

As shown in FIG. 6, while the sheet 10*a* is coming in, the speed change conveyor belts 59*c*, 59*d* is gradually reduced from the speed of the high-speed conveyor belts 62*a*, 62*b* to the speed of the low-speed conveyor belts 56*c*, 56*d*.

Thereafter, the sheet 10*a* is nipped between the speed change conveyor belts 59*c*, 59*d* pushed down by the large-radius portions of the cam rollers 65*b*, 66 and is gradually accelerated to the same speed as that of the high-speed conveyor belts 62*a*, 62*b*.

Before the speed change conveyor belts 59*c*, 59*d* start acceleration, the low-speed conveyor belt 56*c* is in contact with the small-radius portion of the cam roller 65*a* and away from the low-speed conveyor belt 56*d*. Therefore, a difference in speed has no influence on the speed of the sheet 10*a*.

Figure 7:
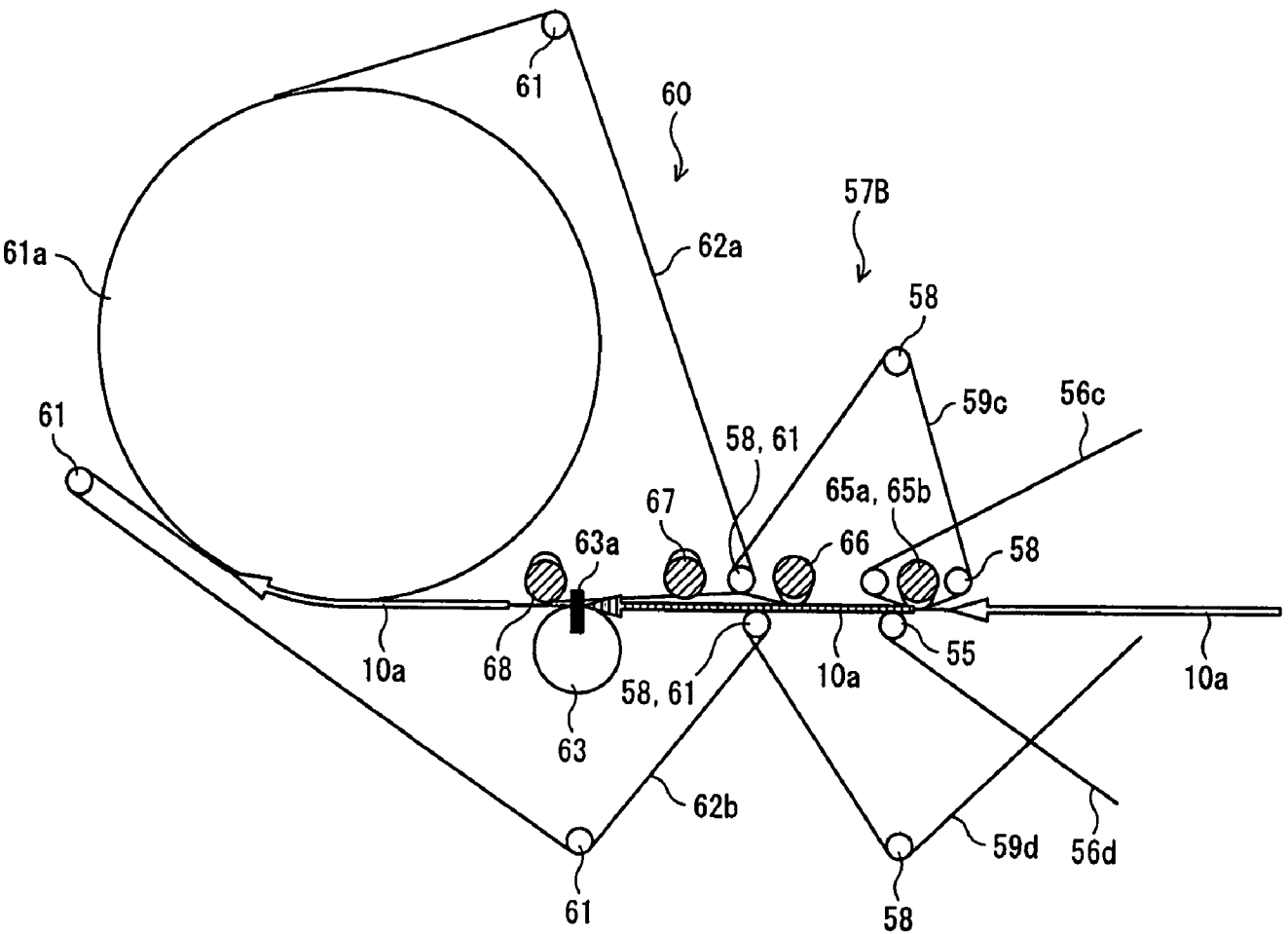
FIG. 7 is a schematic side view showing how a sheet is delivered by the folding machine of the second embodiment of the present invention.

As shown in FIG. 7, the sheet 10*a* accelerated to the same speed as that of the high-speed conveyor belts 62*a*, 62*b* further advances into the nipping area where the sheet 10*a* is nipped between the high-speed conveyor belts 62*a*, 62*b*. The sheet 10*a* advances with the sheet rear end portion nipped between the speed change conveyor belts 59*c*, 59*d* moving at the same speed as that of the high-speed conveyor belts 62*a*, 62*b*.

Thereafter, the front end of the sheet 10*a* abuts the stopper 63*a* of the positioning cylinder rotating at a speed slightly lower than the sheet 10*a*. By further advancing the rear end portion of the sheet 10*a* with the front end abutting the stopper 63*a*, the position and inclination of the front end portion of the sheet 10*a* can be corrected with the stopper 63*a* of the positioning cylinder 63 as reference.

Figure 8:
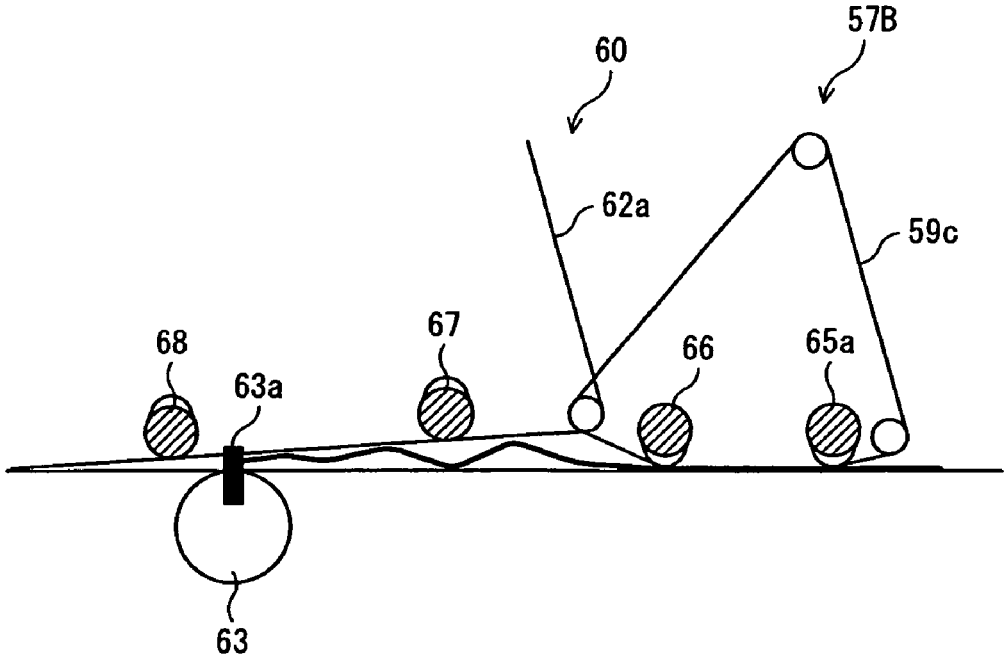
FIG. 8 is a schematic side view showing how a sheet is delivered by the folding machine of the second embodiment of the present invention.

The slack of the cut-off sheet 10*a* produced during correction is absorbed in the space between the belts, as shown in FIG. 8.

Figure 9:
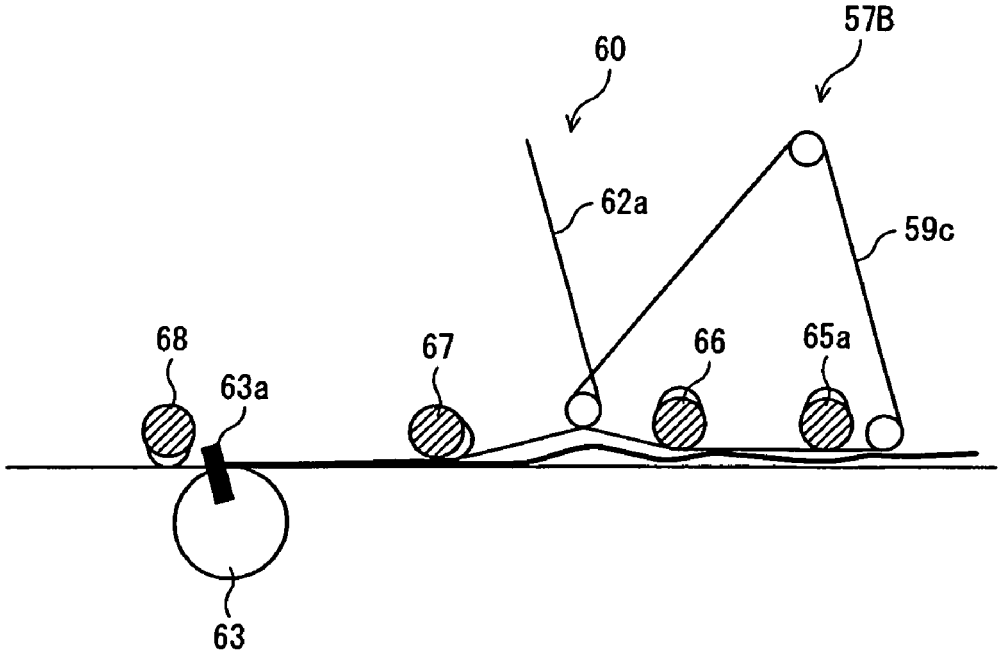
FIG. 9 is a schematic side view showing how a sheet is delivered by the folding machine of the second embodiment of the present invention.

Thereafter, as shown in FIG. 9, the front end portion of the sheet 10*a* whose phase has been corrected is nipped between the high-speed conveyor belts 62*a*, 62*b* by pushing down the high-speed conveyor belt 62*a* by the large-radius portion of the cam roller 68 being gradually rotated. After the front end portion of the sheet 10*a* has been nipped between the high-speed conveyor belts 62*a*, 62*b*, the speed change conveyor belt 59*c* contacts the small-radius portions of the cam rollers 65B, 66 and is moved away from the speed change conveyor belt 59*d* disposed opposite the speed change conveyor belt 59*c*. Thus, the rear end portion of the sheet 10*a* is released from the belts 59*c*, 59*d*. As a result, the slack of the sheet 10*a* produced in correcting the position of the front end of the sheet 10*a* by the stopper 63*a* of the positioning cylinder 63 can be escaped to the rear end portion of the sheet 10*a*. And in order to receive the next sheet 10*a* at a low speed, the speed change conveyor belts 59*c*, 59*d* starts deceleration so that the speed thereof is gradually reduced to that of the low-speed conveyor belts 56*c*, 56*d*.

Thus, by controlling the individual cam rollers in the aforementioned manner, the sheet 10*a* can be reliably delivered without slippage during conveyance in which speed changes take place. In addition, the phase of the sheet 10*a* can be appropriately adjusted by the stopper 63*a* of the positioning cylinder 63.

Third Embodiment

Figure 10B:
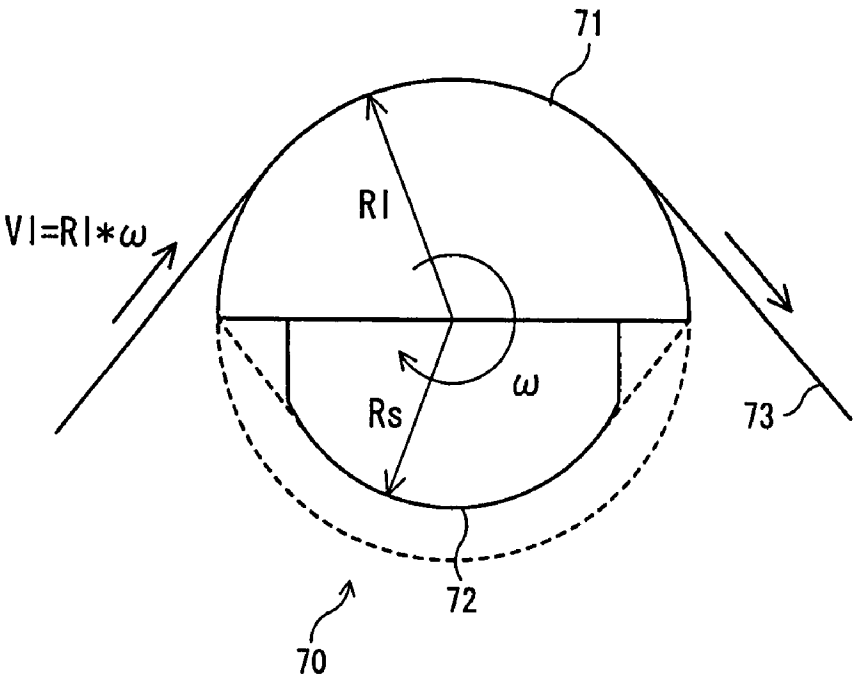
FIGS. 10(*a*) and 10(*b*) are schematic diagrams used to explain the principle of a non-circular drive cam roller used in a folding machine for a rotary printing machine constructed in accordance with a third embodiment of the present invention, FIG. 10(*a*) showing the low-speed operation of the drive cam roller and FIG. 10(*b*) showing the high-speed operation.
Figure 10A:
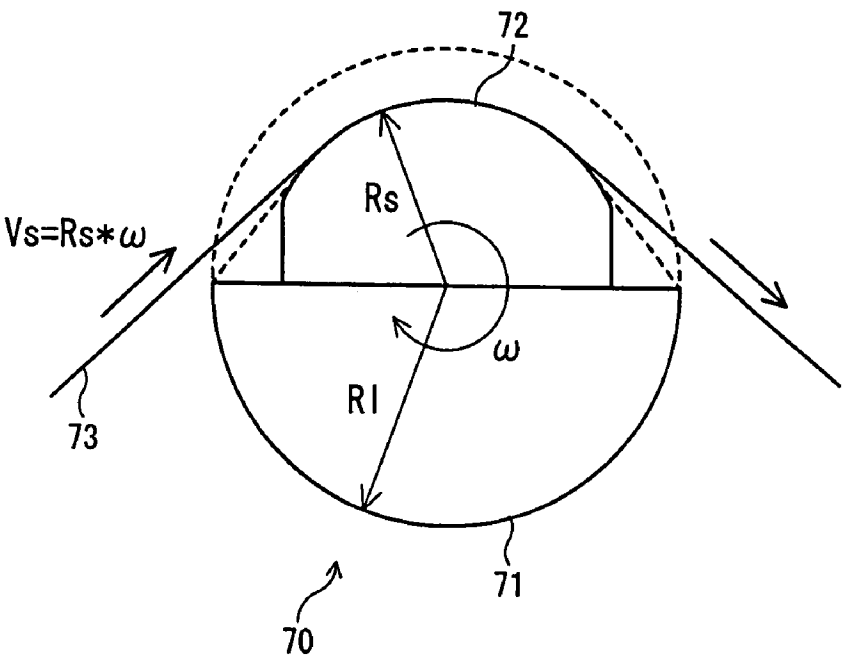
Figure 11:
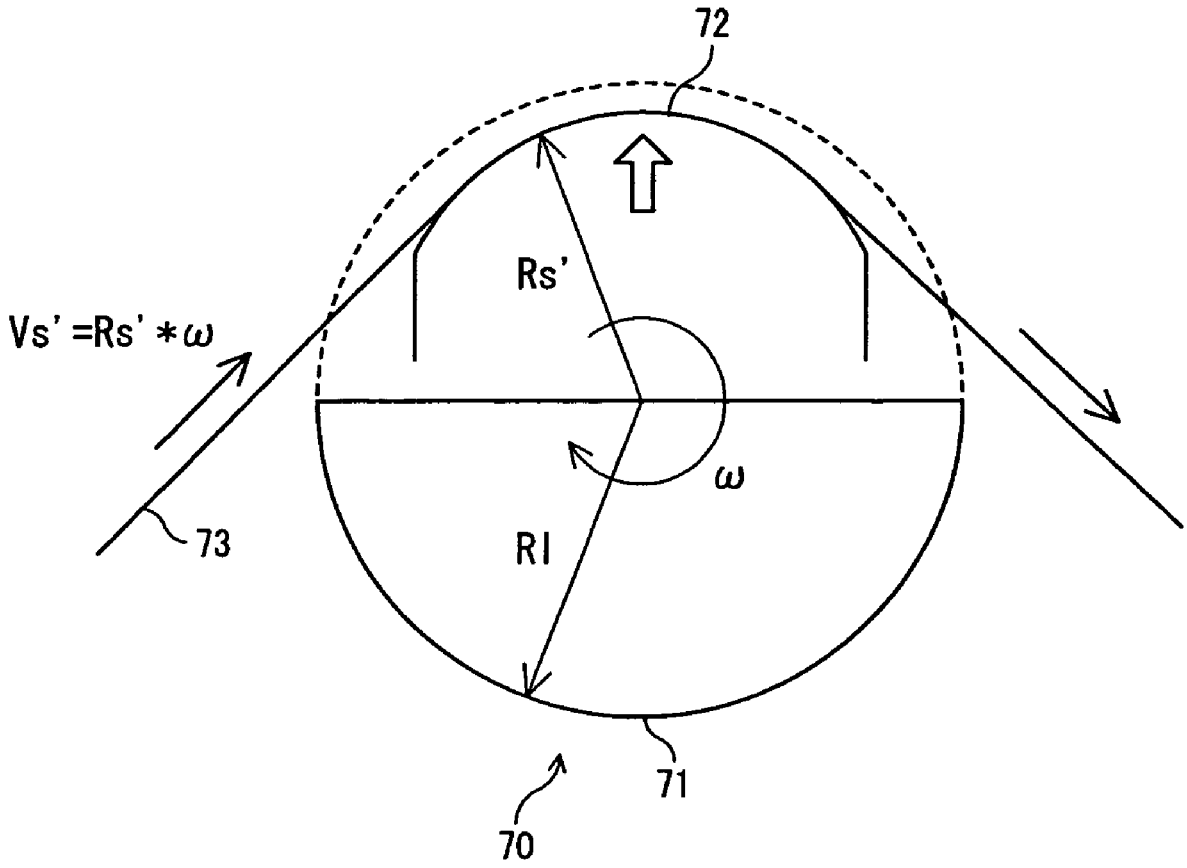
FIG. 11 is a schematic diagram used to explain the drive speed of the non-circular drive cam roller.
Figure 12A:
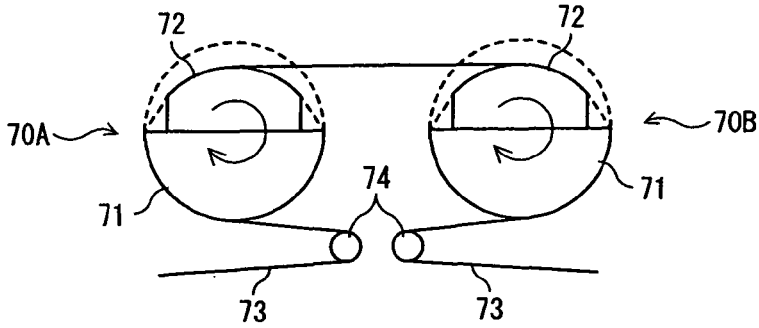
FIGS. 12(*a*), 12(*b*), and 12(*c*) are schematic diagrams used to explain operation of the non-circular drive cam roller.
Figure 12B:
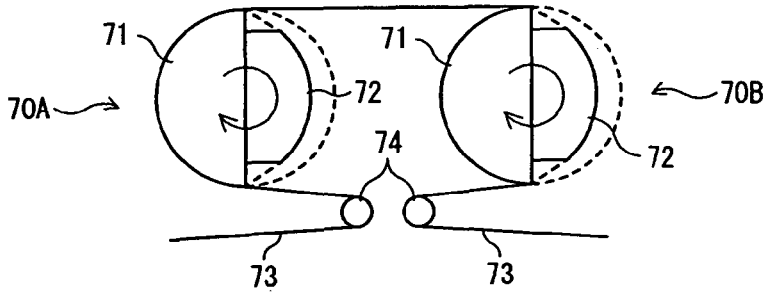
Figure 12C:
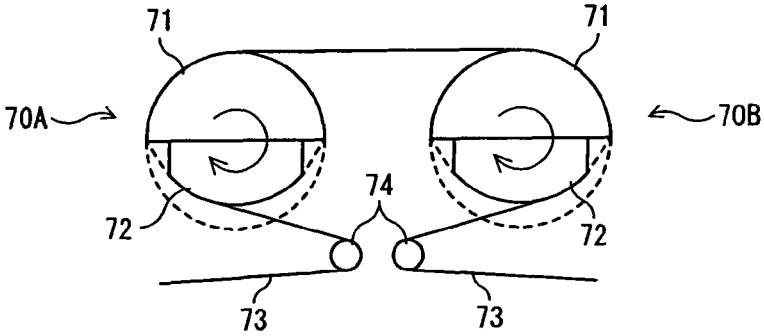

Next, a third embodiment of the disclosed embodiment will be described. FIGS. 10(*a*) to 13(*d*) show a folding machine for a rotary printing machine constructed in accordance with the third embodiment of the disclosed embodiment. FIGS. 10(*a*) and 10(*b*) are schematic diagrams used to explain the principle of a non-circular drive roller; FIG. 11 is a schematic diagram used to explain the drive speed of the non-circular drive roller; FIGS. 12(*a*) to 12(*c*) are schematic diagrams used to explain operation of the non-circular drive roller; and FIGS. 13(*a*) to 13(*d*) are schematic diagrams used to explain variations of the non-circular drive roller.

In this embodiment, attention is paid to the drive system for the speed change conveyor belts 59*c*, 59*d* used in the downstream belt conveyor of the first and second embodiments, and the periodic speed modulation of a speed change conveyor belt is performed without controlling the speed of a drive source such as a motor, etc. More specifically, the periodic speed modulation of a speed change conveyor belt can be realized without changing the speed of a drive source, using a non-circular drive roller (also referred to as a drive cam roller).

That is, as shown in FIGS. 10(*a*) and 10(*b*), the roller for driving a speed change conveyor belt is formed as a drive cam roller 70 having a large-radius portion 71 with a large radius of R1 and a small-radius portion 72 with a small radius of Rs. As shown in FIG. 10(*a*), in the case where the small-radius portion 72 drives the conveyor belt, the line speed of the conveyor belt is decreased to a slow speed Vs. As shown in FIG. 10(*b*), in the case where the large-radius portion 71 drives the conveyor belt, the line speed of the convey belt is increased to a high speed V1.

If the speed change conveyor belt is driven by employing this principle, the speed can be increased or decreased within one rotation of the drive roller.

In addition, if a ratio of the large-radius portion 71 and the small-radius portion 72 is varied, a ratio of a high speed and a low speed during one rotation of the drive roller can be varied to some degree.

Furthermore, as shown in FIG. 11, if the small-radius portion 72 can be radially moved, a speed produced by the small-diameter portion 72 can be varied. That is, if the small-radius portion 72 is moved from the position of the small radius Rs shown in FIG. 10 to the position of the radius Rs' shown in FIG. 11, the line speed of the convey belt driven by the small-radius portion 72 can be changed from the speed Vs to the speed Vs'.

In the case of driving a belt by the roller 70 having the large-radius portion 71 and small-radius portion 72, the entire length of the belt system will vary because the length of the belt wound around the roller varies depending on the radius. Because of this, a device for absorbing a variation in the belt length becomes necessary.

Hence, as shown in FIGS. 12(*a*) to 12(*c*), by disposing drive rollers of the same shape in parallel, and rotating them in the same direction with a belt wound around them about 180°, a variation in the entire belt length due to rotation can be made slight, as shown in FIGS. 12(*a*) to 12(*c*).

When the radius of the small-radius portion is varied, the entire belt length similarly varies. In this case, if a device, which absorbs variations with a spring or an air cylinder, is disposed somewhere in the belt system, a temporal variation immediately after the radius change can be absorbed.

Figures 13A, 13B, 13C, 13D:
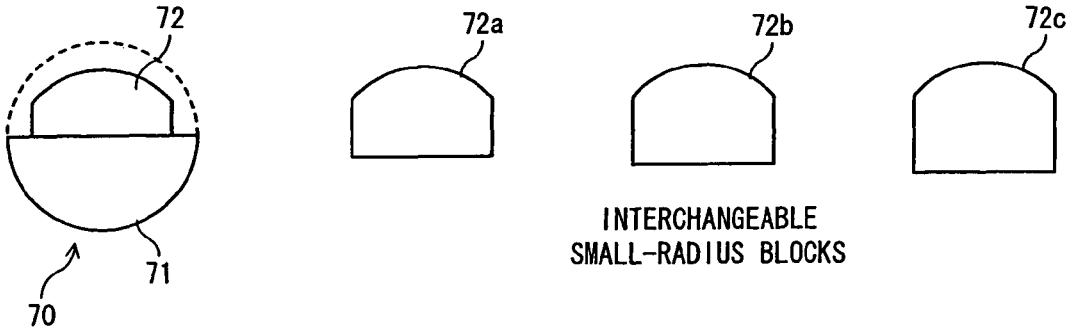
FIGS. 13(*a*) to 13(*d*) are schematic diagrams used to explain variations of the non-circular drive cam roller.

As shown in FIGS. 13(*a*) to 13(*d*), the simplest method of moving the small-radius portion 72 radially is a method of preparing small-radius blocks 72*a*, 72*b*, 72*c* and interchanging them as necessary. It is also possible to easily change the radius position of the small-radius portion 72 by conventional simple mechanisms of cam or wedge types.

In the case where the small-radius portion 72 is formed from a block, the number of blocks is not limited to one block. The small-radius portion 72 may be formed from a plurality of blocks.

Fourth Embodiment

Figure 14:
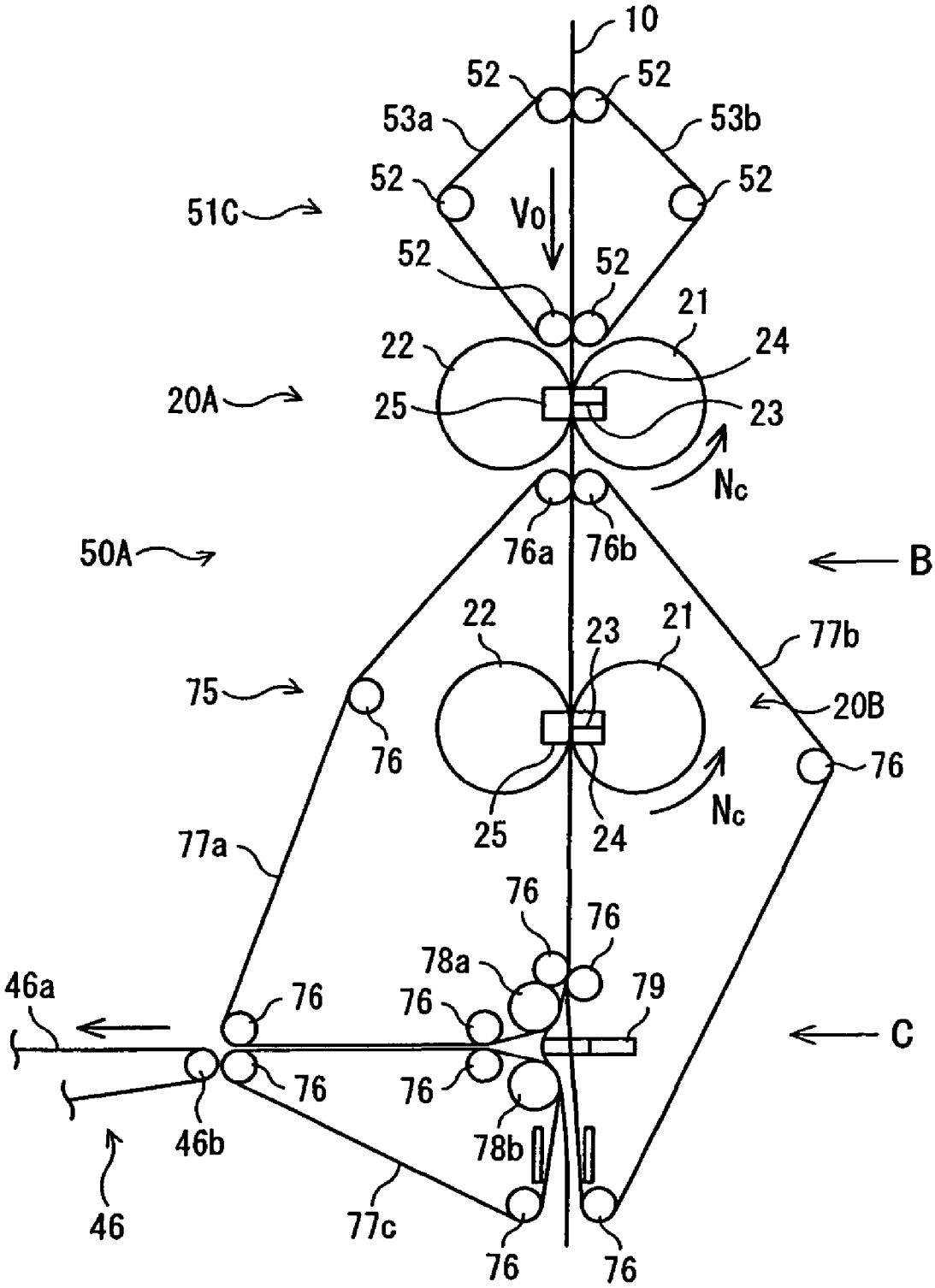
FIG. 14 is a schematic side view showing a folding machine for a rotary printing machine constructed in accordance with a fourth embodiment of the present invention.
Figure 15:
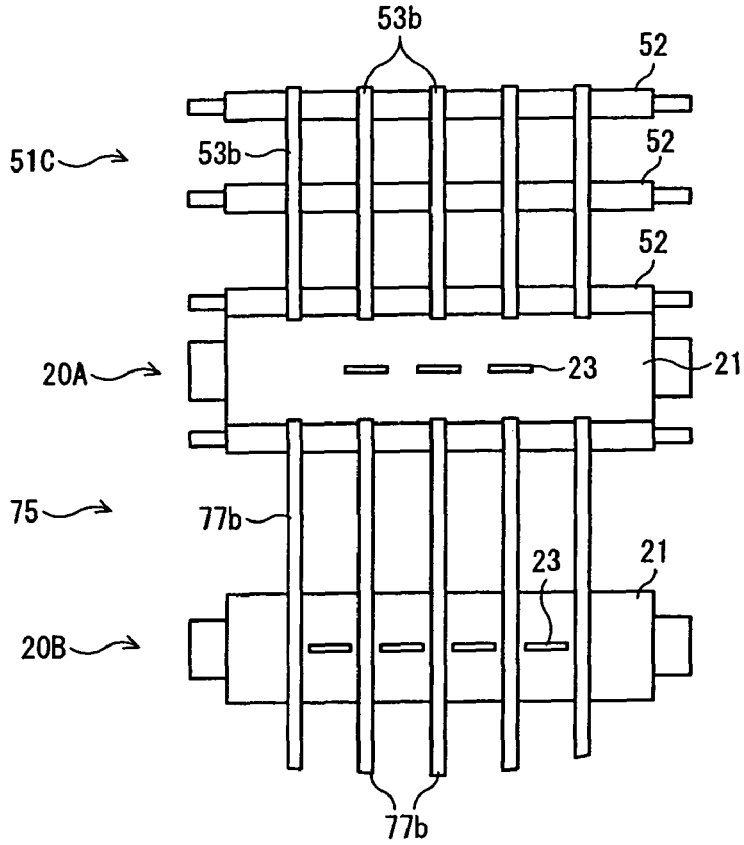
FIG. 15 is a schematic front view (taken in a direction indicated by an arrow B in FIG. 14) showing the essential parts of the folding machine of the fourth embodiment.
Figure 16:
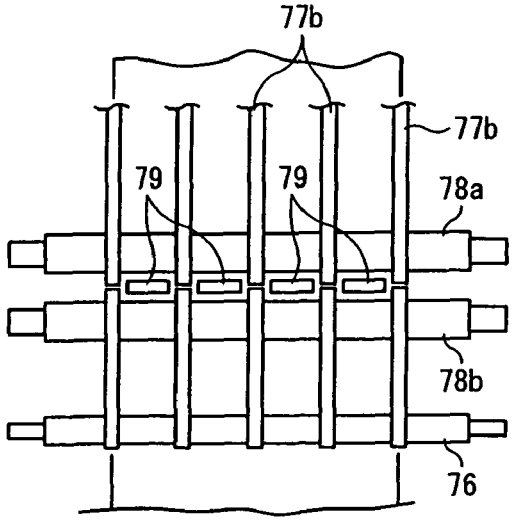
FIG. 16 is a schematic front view (taken in a direction indicated by an arrow C in FIG. 14) showing the essential parts of the folding machine of the fourth embodiment.
Figure 17:
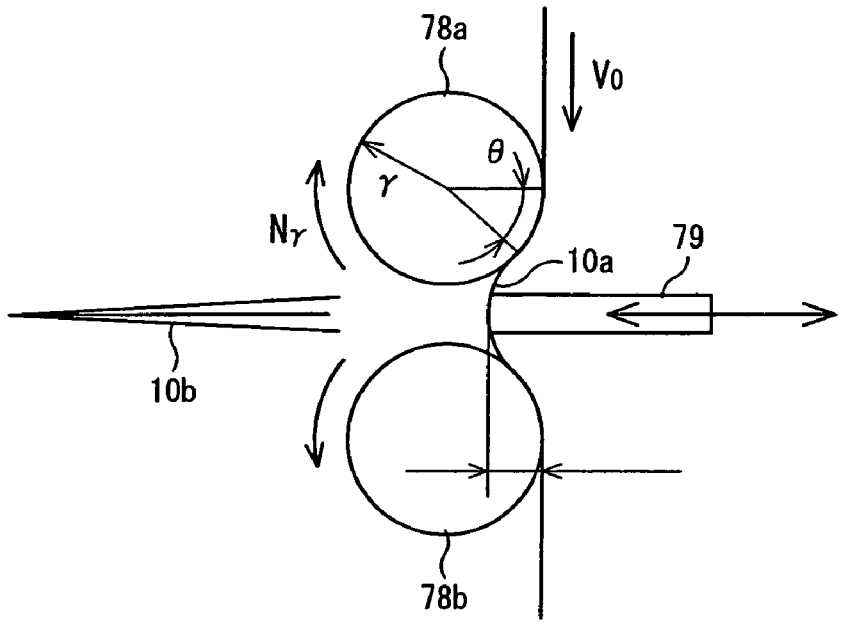
FIG. 17 is a schematic side view showing the essential parts of the folding machine of the fourth embodiment.

Next, a fourth embodiment of the disclosed embodiment will be described. FIGS. 14 to 18(*c*) show a folding machine for a rotary printing machine constructed in accordance with the fourth embodiment of the disclosed embodiment. FIG. 14 is a schematic side view showing the construction of the folding machine; FIG. 15 is a schematic front view (taken in a direction indicated by an arrow B in FIG. 14) showing the essential parts; FIG. 16 is a schematic front view (taken in a direction indicated by an arrow C in FIG. 14) showing the essential parts; FIG. 17 is a schematic side view showing the essential parts; and FIGS. 18(*a*) to 18(*c*) are end views showing the shapes of folded sheets that can be manufactured by the folding machine of this embodiment. A description of the same parts will be partially omitted.

The folding machine 7 of this embodiment is disposed downstream of the drag roller 11 and triangular plate 12 (see FIG. 23). As shown in FIGS. 14 to 16, as with the first embodiment, from the upstream side the folding machine 7 is equipped with an upstream belt conveyor 51A, a first cut-off mechanism 20A, a middle belt conveyor 75, and a second cut-off mechanism 20B. On the downstream side of the second cut-off mechanism 20B, the folding machine 7 in this embodiment is further equipped with a chopper-folder 79 and a paper discharge belt conveyor 46. Since the first and second cut-off mechanisms 20A, 20B are the same as those of the first embodiment, a description of the same parts will not be given.

The upstream belt conveyor 51B comprises a pair of guide belts (nipping belts) 53*a*, 53*b* disposed opposite each other. The middle belt conveyor 75 comprises a pair of guide belts (nipping belts) 77*a*, 77*b* disposed opposite each other. Each of these guide belts 53*a*, 53*b*, 77*a*, and 77*b* comprises a plurality of belts disposed parallel to each other.

The middle belt conveyor 75 is equipped with a pair of endless guide belts (conveyor belts) 77*a*, 77*b* for conveying the web 10 from which a sheet 10*a* is cut off by the second cut-off unit 20B and also conveying the sheet 10*a*, and a pair of endless belts (conveyor belts) 77*a*, 77*c* operating on the downstream side of the chopper-folder 79. The conveyor belt 77*a* has the function of conveying the web 10 before and after the second cut-off mechanism 20B and the sheet 10*a* cut off from the web 10 in cooperation with the conveyor belt 77*b*, and the function of conveying the sheet 10*a* after chopper folding from the chopper-folder 79 in cooperation with the conveyor belt 77*c*. The conveyor belt 77*a* is guided by guide rollers 76, 76*a*, and 78*a*; the conveyor belt 77*b* is guided by guide rollers 76, 77*b*; and the conveyor belt 77*c* is guided by guide rollers 76*a*, 78*b*. The guide belt 77*c*, as with the guide belts 77*a*, 77*b*, comprises a plurality of belts disposed in parallel.

The chopper-folder 79, as shown in FIGS. 14 and 17, is equipped with a chopper-folding blade 79*a*, and a pair of folding rollers 78*a*, 78*b* also functioning as guide belt rollers. The chopper-folder 79 is constructed such that the chopper folding blade 79*a* is laterally or horizontally moved toward and away from the engagement portion between the folding rollers 78*a*, 78*b*.

Note that there is a gap between the conveyor belts 77*a* and 77*c* so that prior to chopper folding, the front end of the sheet 10*a* can be easily inserted between the conveyor belts 77*a* and 77*c*.

A drive source for the chopper-folding blade 79*a* employs an individual motor, so the timing at which the chopper-folding blade 79*a* is laterally moved can be freely set.

In this embodiment constructed as describe above, the chopper-folding blade 79*a* is operated according to the timing according to the cut-off length of the sheet 10*a*. The sheet 10*a* being transferred is inserted between the folding rollers 78*a*, 78*b* provided in the entrance portion of the conveyor belts 77*a*, 77*c*, and is folded in a direction perpendicular to the moving direction of the sheet 10*a*. A folded sheet 10*b* from the folding rollers 78*a*, 78*b* is inserted between the conveyor belts 77*a*, 77*c* and is nipped and conveyed.

In FIG. 17, the angle θ of rotation of the folding rollers 78*a*, 78*b* is given as:

$$\theta=2\pi\cdot Nr\cdot t=Vo\cdot t/r$$

where Vo is the traveling speed (conveying speed) of the sheet 10*a*, Nr is the number of rotations of the folding rollers 78*a*, 78*b*, t is the operating time, and r is the roller radius.

If the lateral or horizontal movement (timing at which the chopper-folding blade 79*a* is operated) of the chopper-folder 79 is controlled so that the lateral or horizontal movement S of the front end of the chopper-folding blade 79*a* becomes $S=r\cdot(\sin\theta+\cos\theta-1)/\cos\theta$, the conveyed sheet 10*a* is properly folded without loosening.

This embodiment functions as described above and can obtain the following advantages:

(1) Since the sheet 10*a* is always nipped and conveyed between conveyor belts, there is no slippage, catching and folding can be performed at accurate timing, stable accuracy of folding can be ensured, and printed surfaces have no stain;

(2) Since the speed of conveyor belts and chopper-folding operation do not change even if a cut-off length varies, the relative positions of the sheet 10*a* and the front end of the chopper-folding blade 79*a* do not change and a variation in the position of the folding line is slight, so that accuracy of folding is stable;

(3) The cycle and operating timing of the chopper-folding blade 79*a* can be easily changed and the required time at the time of the cut-off length or lap width change can be shortened; and (4) Compared with the conventional folding machine, the number of waste papers at the time of the cut-off length or lap width change can be reduced, and the folding machine of the disclosed embodiment is structurally simple, so the manufacturing costs can be considerably reduced.

Figure 18A:
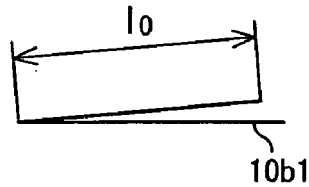
FIGS. 18(*a*) to 18(*c*) are end views showing the shapes of folded sheets that can be manufactured by the folding machine of the fourth embodiment, FIGS. 18(*a*) and 18(*b*) showing a lap width and FIG. 18(*c*) showing delta folding.
Figure 18B:
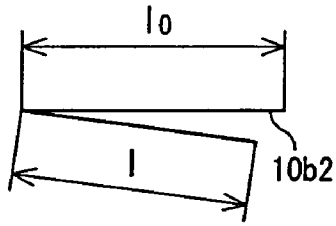
Figure 18C:
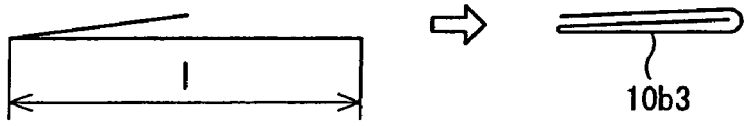

If the operating timing of the chopper-folding blade 79 is varied without varying a cut-off length, not only can the lap width be varied as shown in FIGS. 18(*a*) and 18(*b*), but also ⅓ folding (the first folding in delta folding) can be performed as shown in FIG. 18(*c*). In addition, if another chopper-folder is installed in the subsequent step, various folded sheets can be obtained.

Fifth Embodiment

Figure 19A:
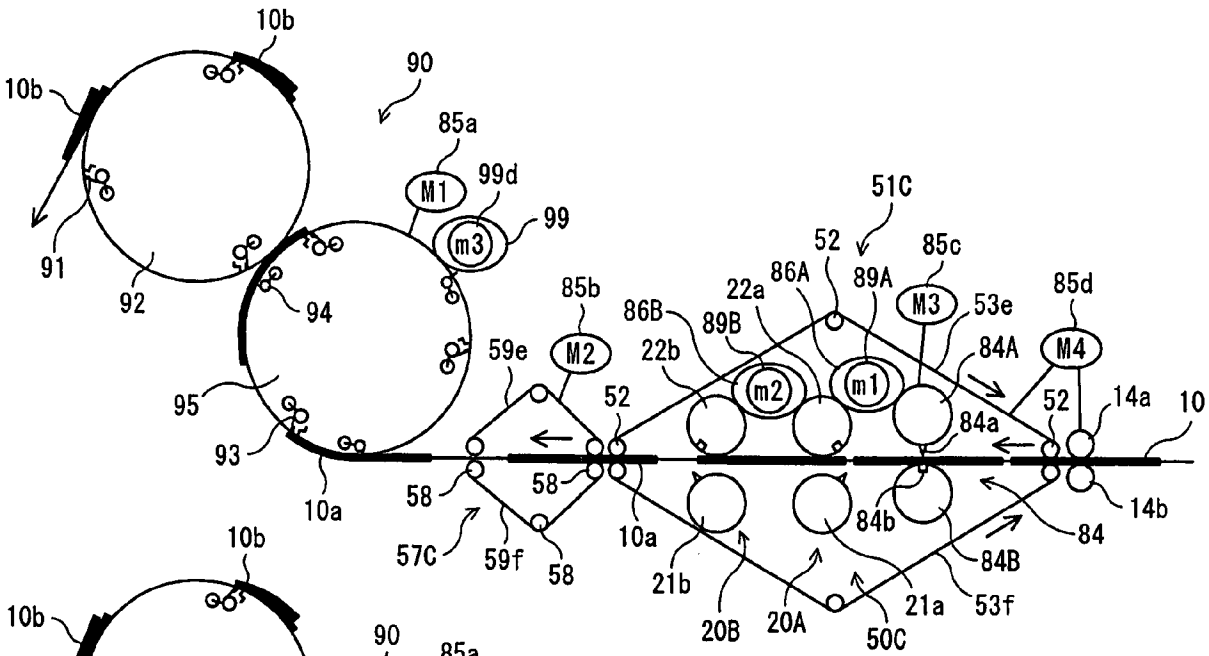
FIGS. 19(*a*) and 19(*b*) are schematic side views showing a folding machine for a rotary printing machine constructed in accordance with a fifth embodiment of the present invention, FIG. 19(*a*) showing how the folding machine is operated when the cut-off length of a sheet is relatively short and FIG. 19(*b*) showing how the folding machine is operated when the cut-off length of a sheet is relatively long.
Figure 19B:
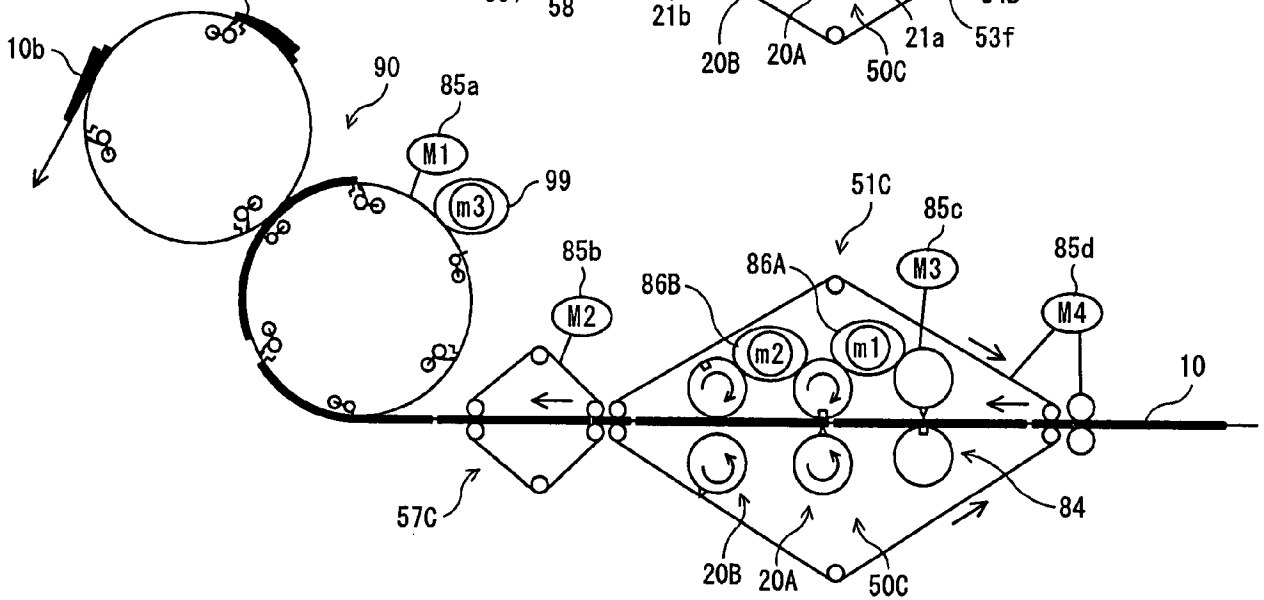
Figure 20:
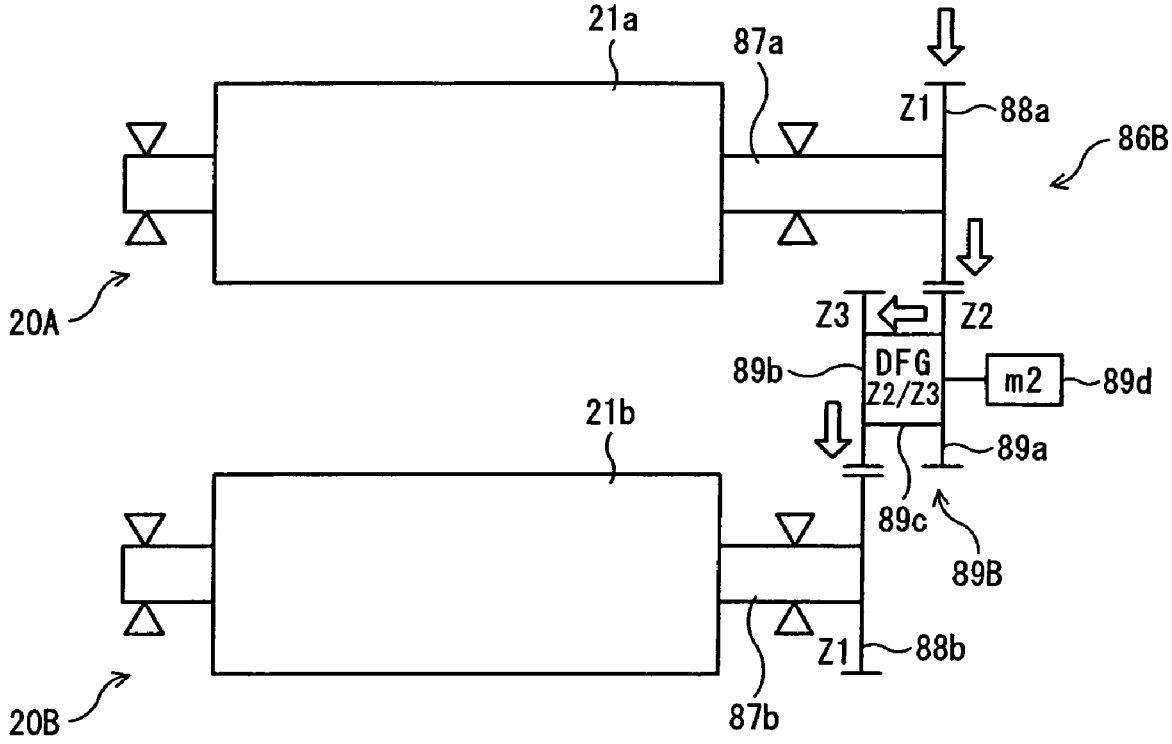
FIG. 20 is a schematic diagram showing the first and second cut-off mechanisms of the folding machine of the fifth embodiment and a relative-phase changer between the first and second cut-off mechanisms.
Figure 21:
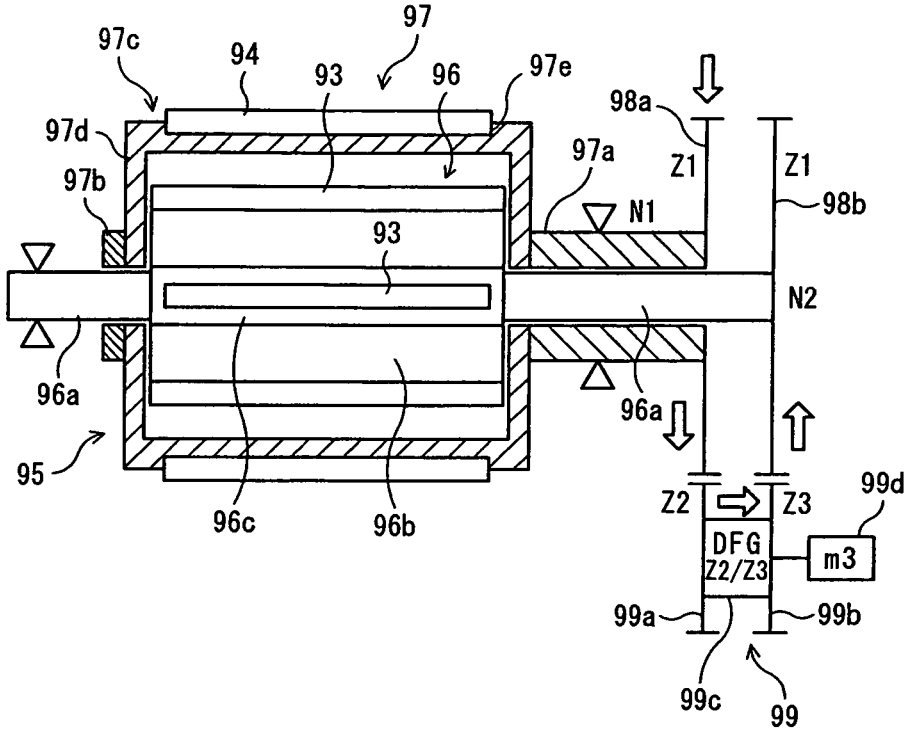
FIGS. 21(*a*) to 21(*c*) are schematic diagrams showing the folding cylinder of the folding machine of the fifth embodiment, FIG. 21(*a*) being a vertical sectional view (taken along line A-A in FIG. 21(*b*)) of the folding cylinder and FIGS. 21(*b*) and 21(*c*) being schematic side views of the folding cylinder.
Figure 21:
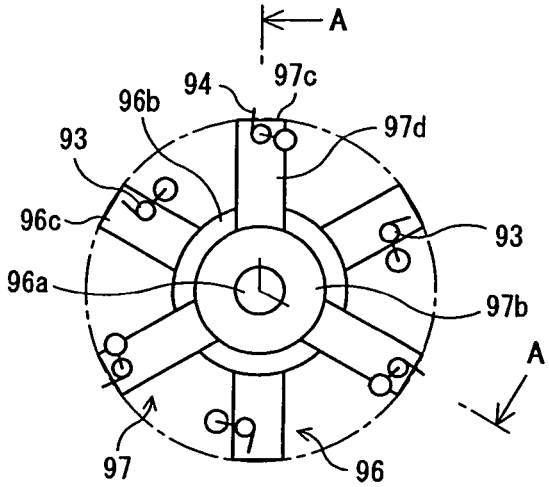
Figure 21:
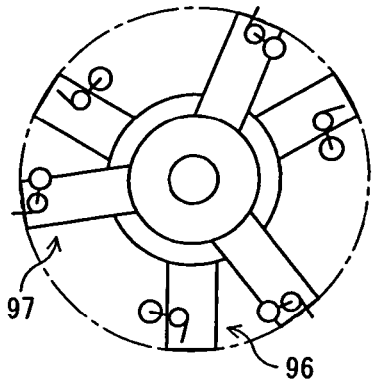

Next, a fifth embodiment of the disclosed embodiment will be described. FIGS. 19(*a*) to 21(*c*) show a folding machine for a rotary printing machine constructed in accordance with the fifth embodiment of the disclosed embodiment. FIGS. 19(*a*) and 19(*b*) are schematic side views showing the folding machine; FIG. 20 is a schematic diagram showing first and second cut-off mechanisms and a relative-phase changer for changing relative phases of the first and second cut-off mechanisms; and FIG. 21 is a schematic diagram showing a folding cylinder. Note in FIGS. 19(*a*) to 21(*c*) that the same parts as those of FIGS. 1 and 2 are given the same reference numerals and therefore a description of the same parts is partially omitted. In FIGS. 19(*a*) to 21(*c*), it is shown that a web 10 and a sheet 10*a* are horizontally conveyed. However, as with the first embodiment, they are conveyed in a vertical direction.

The folding machine 7 of this embodiment, as with the aforementioned embodiments, is disposed downstream of the drag roller 11 and triangular plate 12 (see FIG. 23). As shown in FIGS. 19(*a*) and 19(*b*), from the upstream side, the folding machine 7 is equipped with an upstream belt conveyor (fourth belt conveyor) 51C, a downstream belt conveyor (second belt conveyor) 57C, a catching-folding unit (see reference numeral 40A in FIG. 1), and a paper discharge belt conveyor (see reference numeral 46 in FIG. 1).

The upstream belt conveyor 51C comprises a pair of guide belts (nipping belts) 53*e*, 53*f* disposed opposite each other. The downstream belt conveyor 57C comprises a pair of guide belts 59*e*, 59*f* disposed opposite each other. Each of the guide belts 53*e*, 53*f*, 59*e*, and 59*f* comprises a plurality of guide belts having a predetermined width or less and arranged parallel to each other.

Within the web conveying area of the upstream belt conveyor 51C, there are provided a first cut-off mechanism 20A and a second cut-off mechanism 20B, which are approximately the same as those of the first embodiment. The upstream belt conveyor 51C, first cut-off mechanism 20A, and second cut-off mechanism 20B constitute a cut-off unit 50C for cutting off a sheet with a predetermined length from a web 10.

The cut-off unit 50C is equipped with components peculiar to the variable cut-off length type rotary printing machine. A catching-folding unit 90, as with the first embodiment, is provided downstream of the downstream belt conveyor 57C, but in this embodiment, it is equipped with components peculiar to the variable cut-off length type rotary printing machine.

First, the upstream belt conveyor 51C nips a web 10 between the guide belts (nipping belts) 53*e*, 53*f* and conveys it at a speed equal to the upstream web conveying speed V0. These guide belts 53*e*, 53*f* are endless belts that are guided and driven by a plurality of guide rollers 52 and nip the web 10 while applying nip pressure to both surfaces of the web 10. Upstream of these guide belts 53*e*, 53*f* and in the vicinity of them, nipping rollers 14*a*, 14*b* are disposed to nip the web 10, and the nipped web 10 is conveyed at a speed equal to the upstream web conveying speed V0.

The nipping rollers 14*a*, 14*b* and guide belts 53*e*, 53*f* are together driven by a nipping roller drive motor and a belt drive motor 85*d* (hereinafter referred to simply as a motor M4). The motor M4 can employ, for example, shaftless motors. With this motor M4, the peripheral speed of the nipping rollers 14*a*,

14*b* and the traveling speed of the guide belts 53*e*, 53*f* are made equal to the web conveying speed V0.

Within the web conveying area of the upstream belt conveyor 51C and upstream of the cut-off unit 50C, a scored-line forming mechanism 84 is disposed near the first cut-off mechanism 20A. The scored-line forming mechanism 84 is used to form a horizontally scored line in an uncut web 10 folded in two at a predetermined position and comprises a scored-line cylinder 84A and a receiving cylinder 84B disposed opposite each other and rotating synchronously. The scored-line cylinder 84A is provided with a comb-blade holder (not shown) having comb blades 84*a* in the outer periphery along the axial direction. The receiving cylinder 84B is provided with a rubber bed 25, made of an elastic body such as rubber, for receiving the comb blades 84*a*.

The scored-line cylinder 84A, saw cylinder 22*a* of the first cut-off mechanism 20A, and saw cylinder 22*b* of the second cut-off mechanism 20B are together driven by shaftless motors 85*c* (also referred to as a motor M3). With this motor M3, the scored-line cylinder 84A, saw cylinders 22*a*, 22*b* are driven to rotate synchronously with each other.

A first phase changer 86A is interposed between the scored-line cylinder 84A and the saw cylinder 22*a*, and a second phase changer 86B is interposed between the saw cylinders 22*a*, 22*b*. In this embodiment, the scored-line cylinder 84A is driven directly by the shaftless motor 85*c* (motor M3), the rotational shaft of the scored-line cylinder 84A and the rotational shaft of the saw cylinder 22*a* are connected together by a first power transmission mechanism (e.g., a gear mechanism in this embodiment) 86A, and the power transmission mechanism 86A is provided with a phase changer 89A. Similarly, the rotational shaft of the saw cylinder 22*a* and the rotational shaft of the saw cylinder 22*b* are connected together by a second power transmission mechanism (e.g., a gear mechanism in this embodiment) 86B, which is provided with a phase changer 89B.

With this construction, the scored-line cylinder 84A is driven by the shaftless motor 85*c* (motor M3) so that in a phase state corresponding to a web printing position, the speed the blades 84*a* becomes equal to the web conveying speed V0. The saw cylinder 22*a* is rotated in synchronization with the scored-line cylinder 84A by the first power transmission mechanism 86A, and the saw cylinder 22*b* is rotated in synchronization with the saw cylinder 22*a* by the second power transmission mechanism 86B. At this time, the phases of the scored-line cylinder and saw cylinder 22*a* are properly adjusted by the phase changer 89A so that a relative phase corresponding to a cut-off length is obtained. Likewise, the phases of the saw cylinders 22*a*, 22*b* are properly adjusted by the phase changer 89B so that a relative phase corresponding to a cut-off length is obtained.

The power transmission mechanisms 86A, 86B and phase changers 89A, 89B will be further described with the power transmission mechanism 86B and phase changer 89B as examples. As shown in FIG. 20, the rotational shaft 87*a* of the saw cylinder 22*a* has a gear 88*a* mounted on one end thereof, the rotational shaft 87*b* of the saw cylinder 22*b* has a gear 88*b* mounted on one end thereof, and the phase changer 89B is interposed between the gears 88*a*, 88*b*. The gears 88*a*, 88*b* and phase changer 89B constitute the power transmission mechanism 86B.

The phase changer 89B is equipped with a gear 89*a* meshing with the gear 88*a*, a gear 89*b* meshing with the gear 88*b*, a differential gear (DFG) 89*c* for changing the phases of rotation of these gears 89*a*, 89*b*, and a servo motor 89*d* (motor m2) for driving the differential shaft of the differential gear 89*c*.

The differential gear 89*c* is not shown in detail, but in the case of a differential gear employing a planetary gear, it is equipped with an input internal gear rotating integrally with the input gear 89*a*, an output internal gear rotating integrally with the output gear 89*b*, and a planetary gear meshing with the input and output internal gears. The planetary gear is rotatably installed on a differential shaft that is an eccentric rotational shaft with respect to the axes of rotation of the gears 89*a*, 89*b*, the input internal gear, and the output internal gear.

If the number of teeth of the input internal gear is represented by z2 and the number of teeth of the output internal gear is represented by z3, the number of rotations of the output internal gear is z2/z3 in one rotation of the input internal gear. If the number of teeth of each of the gears 88*a*, 88*b* is Z1, the number of teeth of the gear 89*a* is Z2, and the number of teeth of the gear 89*b* is Z3 (where Z2/Z3=z2/z3), when the number of rotations of the saw cylinder 22*a* (rotational shaft 87*a*) is N1 the number of rotations of the gear 89*a* and the input internal gear is N1×(Z1/Z2), the number of rotations of the output internal gear and the gear 89*b* is N1×(Z1/Z2)×(Z2/Z3), and the number of rotations of the saw cylinder 22*b* (rotational shaft 87*b*) is N1×(Z1/Z2)×(Z2/Z3)×(Z3/Z1)=N1.

Thus, even if the number of teeth (z2) of the input internal gear is differentiated from that (z3) of the output internal gear, the saw cylinder 22*a* and the saw cylinder 22*b* rotate at the same speed. However, if the differential shaft (eccentric shaft) supporting the planetary gear is rotated, the input internal gear and the output internal gear rotate relatively according to the rotation. Therefore, for example, if the planetary gear makes one revolution on the axis of rotation of the input and output internal gears, the number of rotations of the output internal gear is 1−(Z2/Z3) with respect to the input internal gear.

Thus, if the input internal gear and the output internal gear rotate relatively, relative phases of the gears 89*a*, 89*b* are adjusted, and consequently, relative phases of the saw cylinder 22*a* (rotational shaft 87*a*) and the saw cylinder 22*b* (rotational shaft 87*b*) are adjusted.

Although not shown, the power transmission mechanism 86A and phase changer 89A are constructed the same as the aforementioned power transmission mechanism 86B and phase changer 89B.

Next, the downstream belt conveyor 57C will be described. As shown in FIGS. 19(*a*) and 19(*b*), the downstream belt conveyor (acceleration belt conveyor) 57C is equipped with guide belts (acceleration or speed change belts) 59*e*, 59*f*, which are endless belts that are guided and driven by a plurality of guide rollers 58 and nip and convey the web 10 while applying nip pressure to both surfaces of the web 10. With the cut-off sheet 10*a* nipped between the guide belts 59*e*, 59*f*, the sheet 10*a* is conveyed while it is being accelerated from the web conveying speed V0 to a predetermined speed.

That is, in the downstream belt conveyor 57C, the sheet 10*a*, conveyed at a speed equal to the web conveying speed V0 by the upstream belt conveyor 51C and cut off so as to have a predetermined cut-off length, is fed between the guide belts 59*e*, 59*f*, and while the sheet 10*a* is being nipped between the guide belts 53*e*, 53*f* of the upstream belt conveyor 51C, the guide belts 59*e*, 59*f* conveys the sheet 10*a* at a speed equal to the web conveying speed V0, as with the guide belts 53*e*, 53*f*. After the sheet 10*a* is released between the guide belts 53*e*, 53*f*, it is accelerated according to the cut-off length thereof so that there is an appropriate distance between sheets 10*a*. Finally, the sheet 10*a* is accelerated to a speed that synchronizes with the peripheral speed of the downstream catching-folding unit 90, and the sheet 10*a* is delivered onto the catching-folding unit 90. Note that the guide belts 59*e*, 59*f* are driven by a shaftless motor 85*b* (motor M2).

As shown in FIGS. 19(*a*) and 19(*b*), the catching-folding unit 90 comprises a catching cylinder 92 equipped with catchers 91 and a folding cylinder 95 equipped with gripper tools (hereinafter referred to simply as grippers) 93 and folding blades 94, as with the conventional example. The front end of the sheet 10*a* fed through the acceleration belt conveyor 57C is gripped by the grippers 93, and when the sheet 10*a* is being rotated and transferred, the folding blade 94 of the folding cylinder 95 engages with the catcher 91 of the catching cylinder 92. At the position of the engagement, the sheet 10*a* transferred to the catcher 91 is folded along a crease perpendicular to the conveying direction.

In the catching-folding unit 90 illustrated in FIGS. 19(*a*) and 19(*b*), the catching cylinder 92 is equipped with three catchers 91 and the folding cylinder 95 is equipped with three grippers 93 and three folding blades. Therefore, three folded sheets 10*b* are formed in one rotation of each of the cylinders 92, 95.

The folding cylinder 95 and catching cylinder 92 are rotated and driven synchronously with each other by a shaftless motor 85*a* (motor M1). As with the aforementioned power transmission mechanisms 86A, 86B, a similar power transmission mechanism is interposed between the folding cylinder 95 and the catching cylinder 92. The folding cylinder is driven directly by the shaftless motor 85*a* and the catching cylinder 92 is driven by the shaftless motor 85*a* through the power transmission mechanism.

In the folding cylinder 95, the relative positions of the gripper 93 and folding blade 94 need to be adjusted according to the cut-off length of the sheet 10*a*. Hence, as shown in FIGS. 21(*a*) to 21(*c*), the folding cylinder 95 has a first shell portion (first frame) 96 equipped with grippers 93 and a second shell portion (second frame) 97 equipped with folding blades 94. With this arrangement, the relative phases can be adjusted.

As shown in FIGS. 21(*a*) and 21(*c*), the first shell portion 96 is equipped with a first, shaft (folding-cylinder shaft) 96*a*, three pairs of right and left hub portions 96*a* disposed radially from the first shaft 96*a*, and beam portions 96*c* connected to the outer peripheral surfaces of the hub portions 96*b* so that each portion 96*c* extends axially. The grippers 93 are installed in the beam portions 96*c*, respectively. The second shell portion 97 is equipped with second shafts (hollow shafts) 97*a*, 97*b* installed coaxially on the outer periphery of the first shaft 96*a*, three pairs of right and left hub portions 97*c* disposed radially from the second shafts 97*a*, 97*b*, and beam portions 97*d* connected to the outer peripheral surfaces of the hub portions 97*c* so that each portion 97*d* extends axially. The folding blades 94 are installed in the beam portions 97*d*, respectively.

The relative positions of rotation (relative phases) of the first shell portion 96 and second shell portion 97 are changed by a phase changer 99.

This phase changer 99, as shown in FIG. 21(*a*), is constructed the same as the aforementioned phase changers 89A, 89B. That is, the rotational shaft (first shaft) 96*a* of the first shell portion 96 has a gear 98*b* attached to one end thereof, the rotational shaft (second shaft) 96*b* of the second shell portion 97*b* has a gear 98*a* attached to one end thereof, and the phase changer 99 is interposed between the gears 98*a*, 98*b*.

The phase changer 99 is equipped with a gear 99*a* meshing with the gear 98*a*, a gear 99*b* meshing with the gear 98*b*, a differential gear (DFG) 99*c* for changing the phases of rotation of these gears 99*a*, 99*b*, and a servo motor 99*d* (motor m3) for driving the differential shaft of the differential gear 99*c*.

The differential gear 99*c* can be constructed the same as the aforementioned differential gear 89*c*, so it is not illustrated in detail.

The folding machine of the fifth embodiment of the disclosed embodiment is constructed as described above and therefore can obtain the same advantages as the first embodiment by the cut-off unit 50C in which the sheet 10*a* is cut off in two stages from the web 10.

Particularly, in this embodiment, the horizontally scored position by the scored-line forming mechanism 84, the first cut-off length position by the first cut-off mechanism 20A, and the second cut-off length position by the second cut-off mechanism 20B are relatively adjusted according to the cut-off length of the sheet 10*a* by the phase changers 89A, 89B, and the relative positions of the grippers 93 and the folding blades 94 are adjusted according to the cut-off length by the phase changer 99.

Therefore, for instance, in the case where the cut-off length is relatively short, the motors m1, m2, and m3 are operated so that as shown in FIG. 19(*a*), the horizontally scored position, the first cut-off length position, and the second cut-off length position are moved toward each other and also the gripper 93 and the folding blade 94 are moved toward each other. In the case where the cut-off length is relatively long, the motors m1, m2, and m3 are operated so that as shown in FIG. 19(*b*), the horizontally scored position, the first cut-off length position, and the second cut-off length position are moved away from each other and also the gripper 93 and the folding blade 94 are moved away from each other. Thus, adjustments associated with a variation in the cut-off length can be easily and reliably performed.

While this embodiment is equipped with the scored-line forming mechanism 84, it may be omitted. In this case, the first power transmission mechanism 86A and phase changer 89A may be omitted. For instance, the shaftless motor 85*c* (motor M3) may be constructed to directly drive the saw cylinder 22*a* of the first cut-off mechanism 20A; the rotational shaft of the saw cylinder 22*a* and the rotational shaft of the saw cylinder 22*b* may be connected together by the second power transmission mechanism 86B; and the phase changer 89B may be provided in the second power transmission mechanism 86B.

Other Embodiments

While the disclosed embodiment has been described with reference to the preferred embodiments thereof, the invention is not to be limited to the details given herein, but may be modified within the scope of the invention hereinafter claimed.

For example, in the aforementioned first, second, and third embodiments, the catching-folding unit 40A, 90 has been explained as a processor for processing sheets cut off from a web. However, the folder is not limited to the catching-folding unit, but is applicable to various machines. The processor for processing sheets cut off from a web is not limited to the folder, but is applicable to various units such as a discharger for discharging the cut-off sheets outside the printing machine.

INDUSTRIAL APPLICABILITY

The disclosed embodiment can be suitably used in a folder that is a processor for processing sheets cut off from a web.

However, the disclosed embodiment is not limited to the folder, but is applicable to various units such as a discharger for discharging the cut-off sheets outside the printing machine.

What is claimed is:

1. A variable cut-off length rotary printing machine, comprising:

a printing unit that can vary a printing length of a web by changing an outside diameter of a printing cylinder, and a folding machine provided downstream of the printing unit of the rotary printing machine, said folding machine comprising:

a cut-off unit comprising:

a cut-off mechanism configured to cut off the web fed from said printing unit at a predetermined cut-off length position to form a sheet, and a first belt conveyor comprising a pair of conveyor belts, a motor for driving the pair of conveyor belts and a speed control means for controlling a speed of the motor for nipping and conveying the cut sheet at a first speed by the pair of conveyor belts, wherein the speed control means is configured to set the first speed equal to a web conveying speed based upon the predetermined cut-off length;

a processor disposed downstream of said cut-off unit and configured to process the cut sheet conveyed at a constant second speed different from said first speed; and a second belt conveyor disposed between said cut-off unit and said processor and partly directly overlapping the first belt conveyor, the second belt conveyor comprising a variable speed motor which can change a speed during conveyance of the sheet and at least one pair of conveyor belts configured to receive the cut sheet conveyed by said first belt conveyor, and convey said sheet to said processor at the constant second speed;

wherein said second belt conveyor is a variable speed conveyor configured to vary a sheet conveying speed during the conveyance of said sheet so that in receiving said sheet from said first belt conveyor, said sheet conveying speed becomes approximately equal to said first speed at which said sheet is conveyed in said first belt conveyor, and in conveying said sheet to said processor, said sheet conveying speed becomes approximately equal to said second speed at which said sheet is conveyed in said processor through changing the speed of said conveyor belts from said first speed to said second speed by changing the seed of said motor.

2. The variable cut-off length rotary printing machine as set forth in claim 1, wherein said cut-off unit comprises a first cut-off mechanism for partially cutting said web; and a second cut-off mechanism, provided downstream of said first cut-off mechanism, for cutting off said sheet from said web by cutting uncut portions of said web that is not cut by said first cut-off mechanism.

3. The variable cut-off length rotary printing machine as set forth in claim 2, wherein said first belt conveyor nips said web that is to be cut by said second cut-off mechanism, and said cut-off unit further comprises another belt conveyor comprising a pair of conveyor belts for nipping and conveying said web to said second cut-off mechanism.

4. The variable cut-off length rotary printing machine as set forth in claim 2, wherein said folding machine further comprises a first relative-phase changer, interposed between said first cut-off mechanism and said second cut-off mechanism, for changing relative phases of rotation of said first cut-off mechanism and said second cut-off mechanism when varying a cut-off length of said web fed from said printing unit.

5. The variable cut-off length rotary printing machine as set forth in claim 2, wherein said folding machine further comprises a scored-line forming mechanism, provided upstream of said first and second cut-off mechanisms, for forming a horizontally scored line in said web at a predetermined position; and a second relative-phase changer, interposed between said scored-line forming mechanism and said first cut-off mechanism, for changing relative phases of rotation of said scored-line forming mechanism and said first cut-off mechanism when varying a cut-off length of said web fed from said printing unit.

6. The variable cut-off length rotary printing machine as set forth in claim 4, wherein said folding machine further comprises a scored-line forming mechanism, provided upstream of said first and second cut-off mechanisms, for forming a horizontally scored line in said web at a predetermined position; and a second relative-phase changer, interposed between said scored-line forming mechanism and said first cut-off mechanism, for changing relative phases of rotation of said scored-line forming mechanism and said first cut-off mechanism when varying a cut-off length of said web fed from said printing unit.

7. The variable cut-off length rotary printing machine as set forth in claim 1, wherein said sheet conveying speed of said processor is faster than that of said first belt conveyor.

8. The variable cut-off length rotary printing machine as set forth in claim 7, wherein the variable speed second belt conveyor is configured to receive the cut sheet at a speed approximately equal to the sheet conveying speed of said first belt conveyor, accelerate to a speed approximately equal to the sheet conveying speed of said processor, deliver the cut sheet to said processor at a speed approximately equal to the sheet conveying speed of said processor, decelerate to the sheet conveying speed of said first belt conveyor, and then receive a next cut sheet from said web.

9. The variable cut-off length rotary printing machine as set forth in claim 1, wherein said processor comprises a discharger for discharging a sheet cut off by said cut-off unit or a folder for folding a sheet cut off by said cut-off unit along a crease perpendicular to a sheet conveying direction.

10. The variable cut-off length rotary printing machine as set forth in claim 1, wherein said first belt conveyor, said second belt conveyor, said cut-off unit, and said processor are respectively driven by different motors, and a phase of each of said motors can be relatively varied.

11. The variable cut-off length rotary printing machine as set forth in claim 1, wherein said folding machine further comprises an abutting portion, provided between said second belt conveyor and said processor, which a front end of said sheet abuts and by which a conveying phase of said sheet in said folder can be adjusted.

12. The variable cut-off length rotary printing machine as set forth in claim 1, wherein said folding machine further comprises a third belt conveyor, provided downstream of said second belt conveyor and at an entrance portion to said processor, which comprises a pair of conveyor belts for receiving said sheet from said second belt conveyor and conveying said sheet to said processor at the sheet conveying speed of said processor.

13. The variable cut-off length rotary printing machine as set forth in claim 1, wherein said folding machine further comprises a non-circular roller, provided at a position where said sheet is delivered from one of said two belt conveyors adjacent to each other to the other of said two belt conveyors, which guides one of a pair of conveyor belts and has a plurality of surface portions in which distances from a center of rotation to the surface portions are different.

14. The variable cut-off length rotary printing machine as set forth in claim 1, wherein the conveyor belts of said second belt conveyor are driven by non-circular rollers having a plurality of surface portions in which distances from a center of rotation to the surface portions are different.

15. The variable cut-off length rotary printing machine as set forth in claim 1, wherein said cut-off unit comprises a saw cylinder and a receiving cylinder contacting the saw cylinder, an outer diameter of each of the saw cylinder and the receiving cylinder as well as a feeding speed of the web to the cut-off unit being changed when the cut-off length of the web is changed.

16. The variable cut-off length rotary printing machine as set forth in claim 15, wherein the first and second belt conveyors are configured such that in changing the cut-off length of the web, the first conveyer is set to change a speed corresponding to the feeding speed of the web, and the second belt conveyer is set to change a speed substantially corresponding to the speed of the first conveyer in receiving the cut web from the first conveyer and to increase the speed to the constant second speed corresponding to the processor when delivering the cut web to the processor.

* * * * *